US008802950B2

(12) United States Patent
Bibollet

(10) Patent No.: US 8,802,950 B2
(45) Date of Patent: Aug. 12, 2014

(54) HARMONICA

(76) Inventor: Jean-Claude Bibollet, Thones (FR)

( * ) Notice: Subject to any disclaimer, the term of this patent is extended or adjusted under 35 U.S.C. 154(b) by 68 days.

(21) Appl. No.: 13/642,359

(22) PCT Filed: Apr. 15, 2011

(86) PCT No.: PCT/FR2011/000226

§ 371 (c)(1),
(2), (4) Date: Oct. 19, 2012

(87) PCT Pub. No.: WO2011/131856

PCT Pub. Date: Oct. 27, 2011

(65) Prior Publication Data

US 2013/0036894 A1 Feb. 14, 2013

(30) Foreign Application Priority Data

Apr. 19, 2010 (FR) ..... 10 01657

(51) Int. Cl.
*G10D 7/12* (2006.01)

(52) U.S. Cl.
USPC ..... 84/377; 84/378

(58) Field of Classification Search
None
See application file for complete search history.

(56) References Cited

U.S. PATENT DOCUMENTS

| | | | | |
|---|---|---|---|---|
| 2,407,312 | A * | 9/1946 | Magnus | 84/377 |
| 2,473,210 | A * | 6/1949 | Magnus | 84/377 |
| 2,595,381 | A * | 5/1952 | Hugin | 84/377 |
| 2,687,058 | A * | 8/1954 | Obst | 84/377 |
| 2,718,808 | A * | 9/1955 | Magnus | 84/377 |
| 4,342,250 | A | 8/1982 | Robjent | |
| 5,377,574 | A * | 1/1995 | Lempke | 84/377 |
| 5,739,446 | A * | 4/1998 | Bahnson | 84/377 |
| 6,175,067 | B1 * | 1/2001 | Lambert | 84/377 |
| 6,291,751 | B1 | 9/2001 | Antaki | |
| 6,326,532 | B1 * | 12/2001 | Antaki | 84/377 |
| 6,359,204 | B2 * | 3/2002 | Antaki | 84/377 |
| 7,989,687 | B2 * | 8/2011 | Bibollet | 84/377 |
| 2006/0081113 | A1 * | 4/2006 | Lin | 84/377 |
| 2010/0000393 | A1 | 1/2010 | Bibollet | |
| 2013/0036893 | A1 * | 2/2013 | Schaman | 84/377 |
| 2013/0036894 | A1 * | 2/2013 | Bibollet | 84/378 |

FOREIGN PATENT DOCUMENTS

| | | |
|---|---|---|
| CH | 314357 | 7/1956 |
| FR | 2 910 166 | 6/2008 |
| JP | U-48-096932 | 11/1973 |
| WO | WO 93/23846 | 11/1993 |

* cited by examiner

*Primary Examiner* — Robert W Horn
(74) *Attorney, Agent, or Firm* — Oliff PLC

(57) ABSTRACT

The harmonica according to the invention includes a comb or windchest supporting at least one reed plate on which are mounted sound reeds and a peripheral shell allowing to hold the harmonica, said shell including at least one cover plate. Each of its reed plates is sandwiched between the pressing face concerned of the comb and the corresponding cover plate by pressing means for bringing said cover plate closer to the comb between the mouthpiece face of the instrument and the pressing tabs on the side of the bell of the instrument.

15 Claims, 15 Drawing Sheets

Pm
18,29
19
2
3
4
5
8
9
10
51
101
102
209
210
211

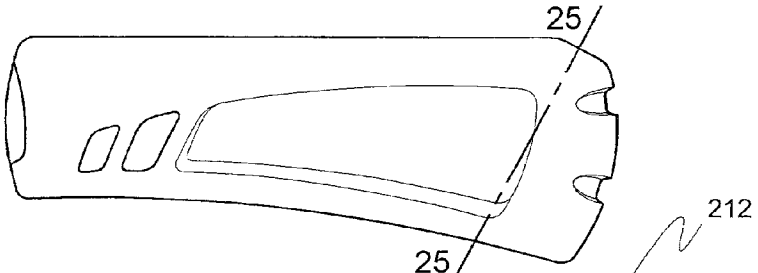
FIG. 21
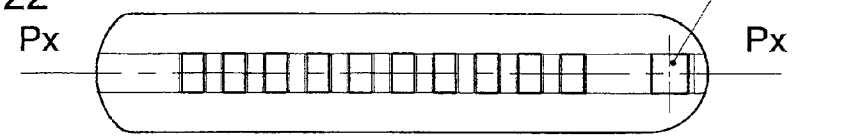
FIG. 22
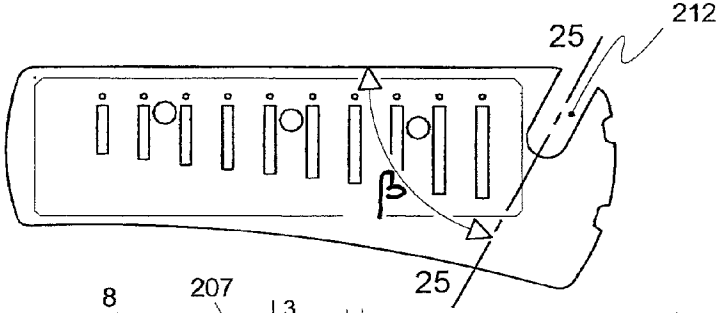
FIG. 23
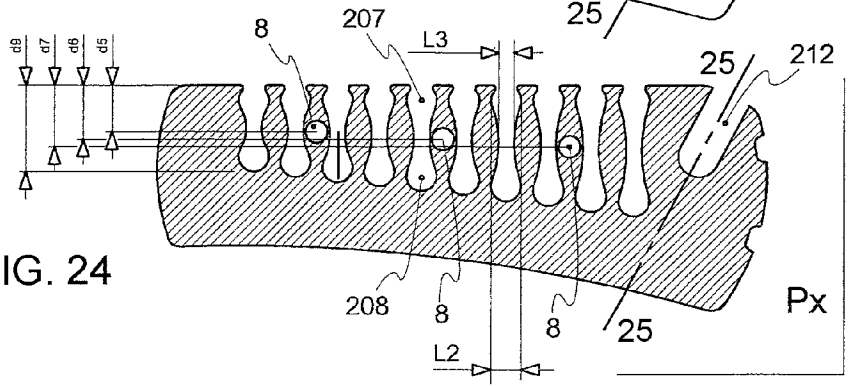
FIG. 24
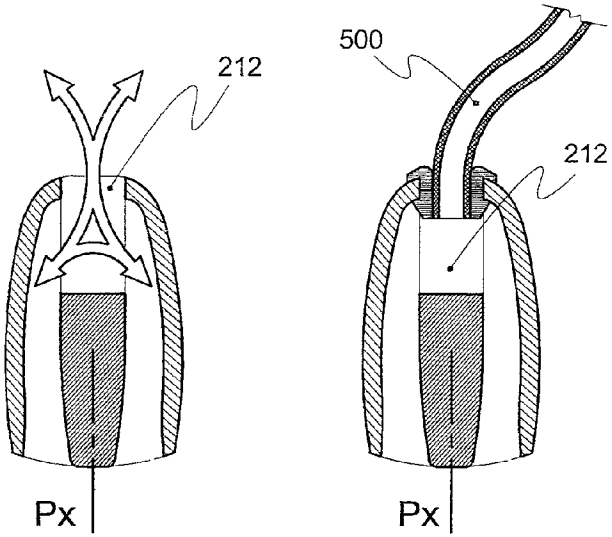
FIG. 26A
FIG. 25
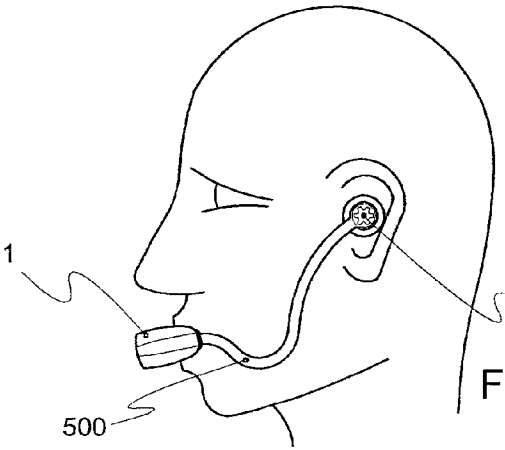
FIG. 26B

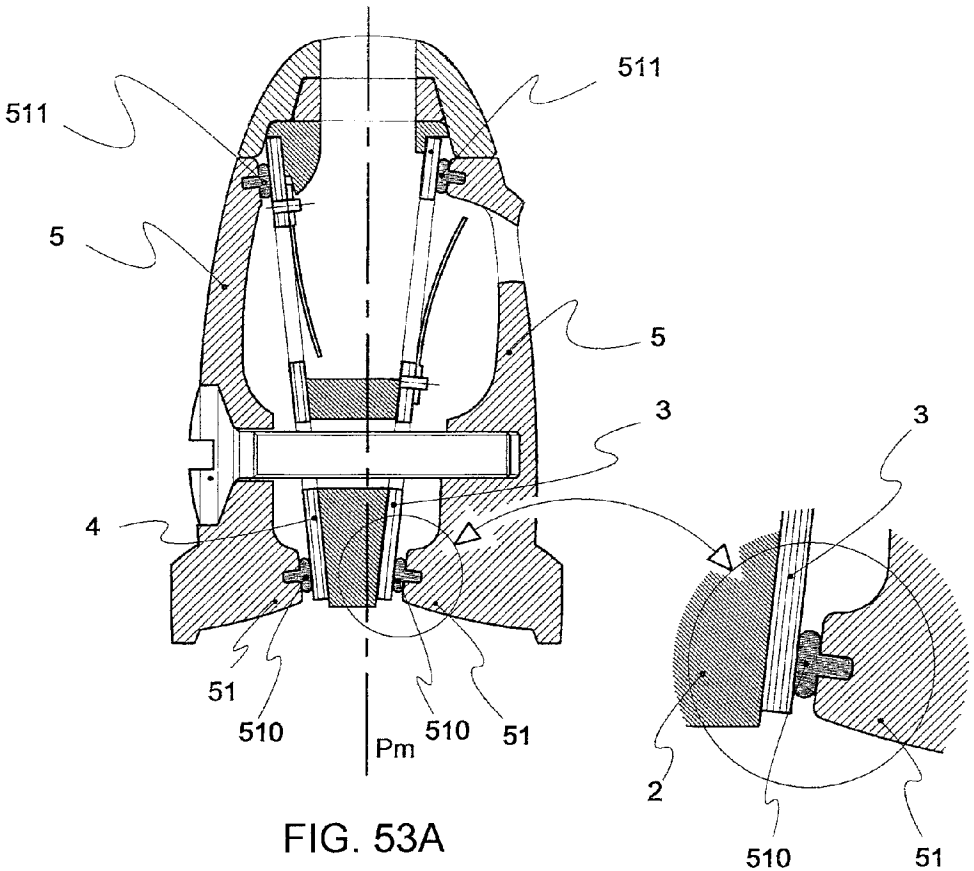
FIG. 53A
FIG. 53B
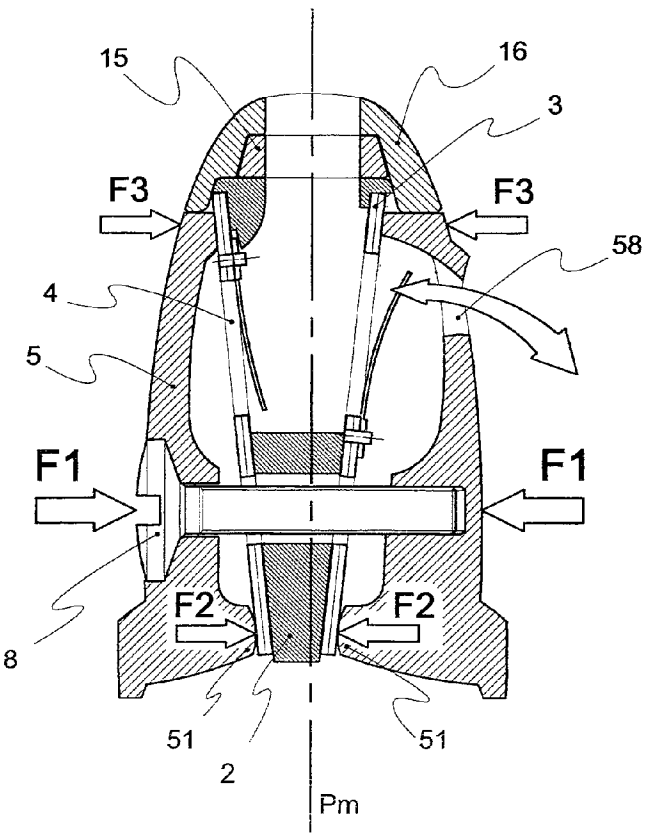
FIG. 52

HARMONICA

TECHNICAL FIELD OF THE INVENTION

The present invention relates to an improvement for simplifying the construction of a harmonica while facilitating the maintenance thereof and improving its sound performance thanks to an optimization of its airtightness.

STATE OF THE ART

The maintenance of prior art harmonicas is often tiresome because their dismounting is long and delicate and, in addition, requires the use of specific tools, in particular very small screwdrivers for very small screws which are fragile and delicate to unscrew as well as to position back.

In addition, these prior art harmonicas are not very efficient from the aeraulic and thus sound point of view, in particular because of the disadvantageous air leaks at the instrument mouthpiece between the comb, the reed plates and the cover plates because said cover plates do not exert all along the mouthpiece face a sufficient pressure to ensure a tightness between these various elements.

Various patents filed in the technical field of harmonicas propose solutions to this problem such as those exposed in U.S. Pat. No. 2,595,381 A, WO 93/23846 A1, JP 48096932 U, U.S. Pat. No. 4,342,250 A which all show or describe harmonicas comprising a comb sandwiched between two reed plates maintained against the comb by two cover plates maintained together by press-screws or equivalent means near the longitudinal ends of said cover plates, thus outside the zones of the harmonica where are located air channels supplying the sound reeds of the instrument.

This conventional embodiment adopted by the majority of the existing products ensures in fact in the end zones of the harmonica a satisfying tightening and thus a satisfying airtightness between the comb, the reed plates and the cover plates for the zones near said screws and thus the air channels supplying the low-pitched reeds of the instrument on the one hand and the air channels supplying the high-pitched reeds of the instrument on the other hand. These pressing means localized near the ends of the instrument are however completely inoperative for all the central longitudinal part of the harmonica where there are the great majority of the sound reeds of the instrument and this is why screws are used in this central zone for pressing the reed plates against the comb, said screws extending through a reed plate and the comb and being screwed into the opposite reed plate. Although this assembly efficiently presses the reed plates against the comb which is opposed to any air leak between said comb and the reed plates, it does not however solve the problem of air leaks between the cover plates and the reed plates all along the central longitudinal part of the mouthpiece face where the lip of each of the two cover plates, pressed against the reed plates only by their two ends, is never tightly pressed against the corresponding external face of said reed plates.

In order to solve this problem, U.S. Pat. No. 2,595,381A proposes to use metal elastic fastener located half the length of the instrument and intended to be fastened onto the back edges of the cover plates on the bell side of the instrument. However, one easily understands that, despite the members with which said cover plates press against the reed plates, the pressure exerted by the fasteners half the length of these cover plates at the back edges thereof on the bell side can only increase, on the mouthpiece side, the gap between the lips of both cover plates and the external face of the reed plate, all along the central part of the instrument mouthpiece, which explains why this arrangement has never been adopted.

OBJECT OF THE INVENTION

Thus, the present invention aims at overcoming these disadvantages and, to achieve its objectives, it first aims at ensuring a fast and easy dismounting of the reed plates for adjusting and cleaning the harmonica while moreover ensuring an optimal tightness all along the mouthpiece face between the cover plates, the reed plates and the corresponding pressing faces of the comb or windchest of the harmonica against which said plates supporting the sound reeds of the instrument are applied.

To this end, the invention proposes a particular design for the cover plates and their associated pressing means, said pressing means being placed as near as possible to the mouthpiece face at various points over the harmonica length and not only in the end zones of the cover plates as it is the case for the prior art harmonicas. Under the action of the pressing screws, and in particular of the screws disposed in the central zone of the instrument, each of the two cover plates swivels about the end of its tabs pressing against the reed plate on the bell side of the instrument until, like two tong jaws, by a cantilever effect, all along the mouthpiece face of the instrument, the lips of both cover plates strongly press against the reed plates, which thus press against the comb so as to ensure a perfect tightness between all these elements including the central part of the mouthpiece face where the prior art devices fail.

In addition, to quickly make the powerful sound reeds vibrate, the invention proposes arrangements of said cover plates and, if necessary, of the comb for ensuring an optimal air supply of said reeds, in particular the low-pitched sound reeds requiring an important air flow for making them vibrate.

The invention also proposes a particular conformation of the air flow channels supplying the sound reeds for allowing the passage of solid press-screws through some lateral separating walls for the channels as well as for optimizing the air flows through said channels.

The improvements suggested by this invention are applicable to all types of harmonicas such as bass, tremolo or diatonic harmonicas each air channel of which supplying one or more sound reeds is connected directly to only one mouthpiece hole as well as chromatic harmonicas having an air distributor mounted so as to slide or swivel and making it possible to send, selectively towards a first channel supplying at least one blow reed and at least one draw reed or towards a second channel also supplying at least one blow reed and at least one draw reed, the air drawn or blown by the player into one mouthpiece hole common to these two adjacent air channels.

The instrument arrangements proposed by this invention are thus a relevant response to the problems of maintenance as well as to the problems of airtightness and aeraulic efficiency in the prior art harmonicas.

Beforehand, in order to facilitate the description and the comprehension of this document, we first agree that the harmonica described is positioned vertically so that the mouthpiece forming the part of the instrument in contact with the musician's mouth forms the upper part of the instrument while the opposite part, the bell, through which the emitted sounds goes out forms the lower part of the instrument.

We thus agree that the harmonica according to the invention, which can have a symmetrical or asymmetrical external shape, is positioned here so that its average longitudinal plane Pm is disposed vertically, said plane Pm being the vertical plane substantially passing through half the thickness of the instrument and thus substantially passing through the middle of the mouthpiece holes and near the middle of the instrument bell. Of course, if all the part of the instrument on one side of said average longitudinal plane Pm is identical to all the part of the instrument on the other side of this average longitudinal plane Pm, this plane Pm then also forms the general longitudinal plane of symmetry of the instrument Ps.

Finally, we agree to designate by blow reeds the reeds fixed on the face of the reed plate oriented towards the internal side of the air channels while the so-called draw reeds will be the reeds fixed against the face of the reed plate outside the air channels. In the present description, we will not thus consider the fact that the so-called blow reeds, mainly intended to vibrate for producing a sound when the player blows into the instrument, can vibrate in some techniques of play even when they are drawn. The same goes for the so-called draw reeds which can vibrate when they are blown in some techniques of play forcing the reeds to occasionally vibrate under the action of an air flow in the direction opposite the direction for which they were initially designed but which remains however obviously their principal mode of vibration. In the same manner, the term 'air input face' always designates in the text the face the air flows through, and then through the window concerned while making the corresponding reed vibrate and, conversely, the term 'exhaust face' designates in the text the face the air leaves after passing through said window, according to the type of reed, draw or blow, associated with the window concerned.

As agreed, the instrument according to the invention comprises the following elements:

- a main body allowing to hold the instrument, comprising either two cover plates between which the comb are sandwiched or only one cover plate placed against the comb whose face opposite said cover plate then forms the other face of the peripheral shape of the instrument. The lower face of said main body is open to be used as a bell while the upper face thereof, opposite the bell, forms the mouthpiece face of the instrument in which are made the mouthpiece holes through which the musician blows or draws the air making the sound reeds of the instrument vibrate. The external shell of said main body can be symmetrical or not with respect to the average longitudinal plane Pm of the instrument and it can also be on the whole symmetrical or not with respect to the vertical plane passing through half the length of the instrument,
- an element, designated by windchest or comb, disposed at least partly inside the cavity in the main body. This comb, which forms or not a monolithic unit with the main body, includes a plurality of air channels whose respective lengths are linked to the length of the reeds they supply,
- at least one reed plate maintained against the corresponding pressing zones of the comb, which pressing zones are in particular formed by the section of the lateral walls separating the air channels from one another,
- several vibrating sound reeds, of the free reed type, formed by fine strips fixed at one of their two ends to the reed plates by any fixation means such as in particular rivets, fasteners, screws, adhesive, weld points or by snapping. Under the combined action of the force exerted by the air drawn or blown by the musician and of the elasticity deflection of said fine strips, the free end of these fine strips can oscillate on both sides of a neutral position while passing through a window having a very slightly bigger size through the reed plate concerned,
- pressing means for pressing the reed plate(s) against the comb and, if necessary, complementary sealing means for avoiding air leaks between the various elements: reed plate(s), comb and cover plates,
- if necessary, means able to be selectively placed or removed for positioning and maintain the reed plates against the corresponding face of the comb when the pressing cover plates are dismounted.

According to a first feature, the two planes passing through the faces of the reed plates placed against the corresponding faces of the windchest can be parallel to one another or, on the contrary, convergent so as to form either a dihedron whose edge common to said two planes is positioned on the bell side of the instrument in the space beyond said bell, said dihedron being then open towards the instrument mouthpiece, or, on the contrary, the two planes are convergent to one another so as to form a dihedron whose common edge is positioned on the mouthpiece side of the instrument in the space beyond said mouthpiece, said dihedron being then open towards the instrument bell.

According to another feature, for making channels with a particular shape, the windchest can be advantageously made in two parts assembled together, for example in the average longitudinal plane Pm of the instrument by sticking, snapping, welding or any other means and in particular simply by screwing the press-screws of the cover plates between which the comb is sandwiched, this mode of assembly being advantageous in that the two half-windchests can be separated, whenever it is desired, for facilitating their cleaning.

According to another feature, the windchest can advantageously be made out of a slightly elastically deformable material so as to adapt itself to the possible deformation of the reed plates, which thus avoids any air leaks between the faces of the reed plates and the corresponding faces of said windchest.

According to another feature of a particular embodiment, the windchest forms a monolithic unit with the upper cover plate and/or the lower cover plate.

According to an important feature of a preferred embodiment, the reed plates are not firmly fixed to the comb by screws which must be removed in order to dismount said reed plates from the comb as it is the case for the prior art harmonicas but they are sandwiched between the comb and the corresponding pressing face of the cover plate concerned, the latter having a rigid structure for not becoming deformed by the pressure exerted by the pressing means against the external face of said cover plate in order to bring this cover plate closer to the comb. The rigidity of the cover plates can be obtained by thickening and/or ribbing in particular in the form of members disposed against the internal face of the cover plate.

The pressing means can advantageously be formed by at least one screw whose head presses against the external face of the cover plate concerned and whose threaded part is screwed either directly into the comb or into the opposite cover plate or into a threaded insert in the comb or into a female screw whose head presses against the external face of the opposite cover plate. All the screws can also be of the female type and screwed onto male pins firmly fixed or not to the comb.

According to another feature, the screws can be advantageously flexible in their longitudinal direction for better following their small angular tilting movement when, under the force generated by the pressing means, their pressing tabs come into contact with the reed plate and their lip is folded against the reed plate on the side of the instrument mouthpiece. This longitudinal flexibility of the screws can be obtained by using a material having suitable qualities of flexibility and/or by a particular geometry of the screw whose stem has an unthreaded part which could advantageously have a diameter inferior to the diameter of the threaded part. Indeed, if the median part of the screw must be thin enough so as to be flexible, the threaded part of the screw must have a sufficiently large diameter so as to offer a sufficiently large peripheral surface for providing the outer threads and the corresponding inner threads with some shear strength in particular if the latter are made directly in cover plates out of a thermoplastic material or a thermosetting material or light alloys.

According to an important feature, the harmonica according to the invention comprises at least one screw, as described above, inserted into the part of the instrument delimited, in the longitudinal direction of the harmonica, by the most low-pitched reed and the most high-pitched reed. To be more precise, one can thus say that the instrument comprises at least one press-screw disposed in the part of the instrument between the two planes perpendicular to the average longitudinal plane Pm of the instrument, one passing through the longitudinal axis of the air flow channel supplying the most high-pitched reed of the instrument and the other passing through the longitudinal axis of the channel supplying the most low-pitched sound reed of the instrument.

According to another feature, the longitudinal axis of at least one of the press-screws for the pressing cover plates is positioned at a distance from the mouthpiece face inferior to the distance separating said mouthpiece face from the bottom of the air flow channel supplying the most low-pitched reed of the instrument.

According to another embodiment, the harmonica according to the invention comprises at least one press-screw for the pressing cover plates extending through a lateral separating wall of two adjacent channels and the axis of the stem of said screw is positioned at a distance from the mouthpiece face inferior to the distance separating said mouthpiece face from the longest bottom of the two air channels adjoining the separating wall said screw stem extends through.

According to another important feature, in the lower zone of the instrument between the press-screw concerned and the face of the instrument bell, each pressing cover plate presses against the external face of the reed plate either directly by means of a pressing tab forming then a monolithic unit with said cover plate or via an added pressing tab firmly fixed to said cover plate and/or to the reed plate concerned.

The above-described press-screw is thus placed in an intermediate position between the mouthpiece face of the instrument, where is located the upper end of the reed plates against which presses the lip of the pressing cover plate, and the tab of the cover plate pressing near the lower end of said reed plate on the bell side of the instrument.

As the cover plate presses against the reed plate via its pressing tab ensuring the placement against the comb of the lower part of the reed plate, thus of the part of the reed plate on the bell side of the instrument, one then understands that, by cantilever effect, the pressure exerted by the above-described screw against the external face of the cover plate will result, on the mouthpiece side of the instrument, in a very strong pressing effect of the lip of the pressing cover plate against the corresponding external face of the reed plate which will be thus strongly pressed against the comb while avoiding any air leak at the mouthpiece between said comb and the reed plate as well as between the reed plate and said cover plate.

According to a particular embodiment, the harmonica according to the invention comprises one or two cover plate(s) firmly pressing the reed plate(s) against the corresponding face(s) of the comb such as described above, and said cover plates are made so as to be sufficiently rigid so that, by cantilever effect in the vertical direction as well as in the horizontal direction, only one screw substantially disposed half the length of the instrument or ideally two screws, one substantially at one third and the other at two thirds of the length of the instrument, are sufficient for maintaining the various elements in position relative to one another and to ensure the tightness between the faces pressing said elements against one another. Such an arrangement is of course very advantageous in that the maintenance is facilitated because the various elements forming the harmonica can be very quickly and very easily dismounted but it is also very interesting from the economical point of view for such a harmonica can be very cheaply produced with respect to a prior art harmonica comprising a lot of screws of various shapes, diameters and lengths for pressing the reed plates against the comb on one hand and for fixing the cover plates on the other hand.

According to other embodiments, the harmonica according to the invention comprises three or four press-screws, such as described above, exerting their action on the pressing cover plate comprising pressing tabs judiciously distributed and positioned on the one hand in the lower zone of the reed plates extending in the longitudinal direction of the instrument between the sound reeds and the instrument bell and on the other hand in the lateral zones of the reed plates extending between the high-pitched sound reeds and the end close to the reed plate as well as between the low-pitched sound reeds and the end close to the reed plate concerned. These various pressing tabs thus press on three of the four sides of the reed plates while, by cantilever effect, the upper lip of the pressing cover plate presses the fourth side of the reed plate against the comb over the entire length of the mouthpiece. The reed plate concerned thus takes advantage of a pressing effect against the comb exerted on all its periphery which can advantageously be supplemented, if necessary, by central pressing zones positioned in the central zone of said reed plate exerted via central pressing tabs firmly fixed to the reed plate or the pressing cover plate concerned. The above-mentioned central pressing tabs are thus located between two adjacent press-screws and thus between the free end and the fixed end of two contiguous sound reeds and advantageously opposite the wall of the comb separating the two air flow channels supplying the two sound reeds mentioned.

According to another feature, complementary pressing means for pressing the reed plate against the comb can advantageously be placed between the zone of the reed plate on which presses the tab of the pressing cover plate and the opposite zone of said reed plate, on the mouthpiece side, on which presses the lip of said pressing cover plate. These complementary pressing means can be formed either by pressing tabs via which the pressing cover plate concerned presses directly onto the reed plate, such as described above, or by an elastically deformable element in particular such as a spring or an element made out of an elastically deformable material is inserted between the pressing tab concerned and the corresponding external face of the reed plate or between the cover plate and the corresponding external face of the reed plate. According to a particular embodiment, these complementary pressing means are formed by a helical spring or a O-shaped seal or a seal having any other shape concentrically disposed around the axis of the press-screw concerned.

According to another feature, the harmonica according to the invention comprises elements projecting from the faces of the comb against which the reed plates are pressed, and said elements cooperate with holes of complementary shapes and sizes in said reed plates so that they can be pressed against the comb only when they are correctly assembled i.e. only when they are positioned on the good side of the comb on the one hand and disposed in the good direction on the other hand, the most high-pitched reed being then positioned opposite the shortest air flow channel while the most low-pitched sound reed is positioned opposite the longest channel, in order to avoid any wrong assembly likely to irremediably damage the sound reeds which are very fragile.

According to another feature, the comb advantageously comprises means for positioning and maintaining in position the reed plates, these means in particular comprising hook-shaped elements projecting from the face against which presses the reed plate concerned, said hooks being inserted into the comb at one of the peripheral edges of said reed plate when the latter is placed. For placing the reed plate, it is thus sufficient to slide its edge concerned into the hook(s) in such a way that the internal face of the reed plate then presses against the corresponding external face of the comb while the external face of said reed plate presses against the corresponding internal face of the hook(s). These hooks can be formed by added parts firmly fixed to the comb but, advantageously, they can also form with it a monolithic unit directly in the mold when the comb is produced by a molding process.

Contrary to the above-described embodiment, it is conceivable that these means of hooking and positioning the reed plates are composed of elements firmly fixed to the reed plate concerned cooperating with complementary means in the comb.

According to another feature of the invention, the harmonica according to the invention comprises immobilizing means for maintain the reed plates in position against the face concerned of the comb when the pressing cover plate of the instrument have been placed so as to prevent said reed plates from falling when they are not sandwiched any more between the comb and the cover plate, as described above. These immobilizing means totally or partly fixed to the comb or the reed plate concerned can be composed in particular of clip-shaped hooks firmly fixed to the comb and able to get elastically deformed when placing said reed plate against the external face of this reed plate which is thus pressed against the comb. These immobilizing means of the reed plates can also be composed of cams or latches mounted so as to swivel about an axis substantially perpendicular to the reed plate concerned or of sliding bolts which can advantageously be a cam nose associated with return means allowing it to automatically move into an immobilizing position of the reed plate when the latter is moved into its position against the comb.

According to another embodiment, the immobilizing means are formed by at least one U-shaped double hook extending right through the comb and being able to swivel about its central part in such a way that one of its two branches can firmly presses against the external face of the first reed plate while the second branch firmly presses against the external face of the second reed plate.

According to another feature, openings are advantageously arranged directly through the large longitudinal faces of one or both cover plate(s) of the instrument and, at least on the side of some draw reeds, said openings being advantageously positioned opposite the free end of the draw reeds concerned and between the mouthpiece face of the instrument and the gripping zone of the instrument covered by the player's hand when he/she holds the harmonica. These openings are intended to favorably ensure a short air supply circuit, directly through the cover plate concerned, in particular for the draw sound reeds whose corresponding part of the windows, swept by the free part of the sound reed when oscillating, through which the air must flows during these oscillations, is located far from the bell through which all the drawn air must flow in the traditional prior art arrangements. In addition, these openings are intended to allow a better diffusion of the sounds emitted, in particular by said draw reeds penalized regarding their sound efficiency because of their positions at the bottom of the cover plates.

According to another feature, to increase at the most the force pressing the reed plate against the comb and exerted by the pressing cover plate on the mouthpiece face of the instrument, the pressing means formed by pressing screws are inserted as near as possible to said mouthpiece face and so that the stem of said screws does not enter an air flow channel, the longitudinal axes of at least some of said air channels can be oriented in a slightly oblique way with respect to the mouthpiece face of the instrument. Thanks to this arrangement, without increasing the center distance of axes of the mouthpiece holes, the lateral separating walls between the channels widens as one moves away from the mouthpiece face towards the bell, which quickly offers a sufficient width to the separating wall concerned so that the pressing screw concerned can be inserted through said separating wall while being positioned at a distance from the mouthpiece face of the instrument inferior to the distance of said mouthpiece face where is located the bottom of the longest of the two air flow channels adjoining the wall into which the above-mentioned press-screw is inserted.

According to a particular embodiment, in order to be able to insert several press-screws as near as possible to the mouthpiece face such as described above, the air flow channels in said comb are divided into several groups. Inside each group, the longitudinal axes of said channels are advantageously parallel to one another while said longitudinal axes of one of said groups of channels are divergent with respect to the longitudinal axes of the channels of another group of adjacent channels so that the separating wall separating the two contiguous air channels belonging to two adjacent groups widens as one moves away from the mouthpiece face towards the bell face of the instrument.

According to an alternative embodiment, the air channels are divided into three groups, the longitudinal axes of the channels in the central part of the harmonica are perpendicular to the mouthpiece face of the instrument while the longitudinal axes of the channels of each of the two other groups are divergent in a symmetrical way with respect to the plane perpendicular to the mouthpiece face and passing through half the length of the instrument. Inside each of the above-described three groups, the longitudinal axes of the channels forming said group are advantageously parallel to one another.

The various arrangements suggested for the air flow channels aim, above all, at facilitating the air flows by avoiding the swirling movements which reduce the reactivity of the sound reeds by delaying their vibration as well as their braking when the air flow is reversed in the same channel, when passing from a blown flow to a drawn flow and conversely, which is very frequently the case when playing.

A second objective is to position the flows of blown air as well as the flows of drawn air in such a way that their angle of incidence with respect to the sound reeds they make vibrate are optimal, which allows to save air and to make more powerful reeds and/or more low-pitched reeds and/or more reeds vibrate.

To this end, according to a first embodiment, at least some air channels are conical, their width measured in the longitudinal direction of the instrument at the mouthpiece face being superior to their width at their end on the bell side of the instrument in order to increase the pressure of the blown air at the free end of the draw reeds while moreover generating an optimal depression at the free end of the draw reeds.

According to another embodiment, the width of at least some air channels, measured in the longitudinal direction of the instrument, has half the length of said channels a value inferior to the width of said channels measured at the free end of the draw reed and at the free end of the draw reed both contained in the air channel considered.

According to another feature, the width of the channels supplying the low-pitched reeds of the instrument is inferior to that of the channels supplying the high-pitched reeds of the instrument.

According to another feature, the bottom of the air flow channels on the bell side of the instrument has a semicircular shape or a semi-elliptic shape to allow an optimal flow of blown air.

According to another embodiment, the two sides of at least some air channels have an helical shape in order to generate a double vortex in each of said channels, the two vortices being symmetrically arranged in each channel with respect to the plane passing through the longitudinal axis of the two reeds concerned. In this embodiment, for the first face of the windchest against which presses the first reed plate, the longitudinal edges of the channel considered deviate, on the whole, from one another when one moves away from the instrument mouthpiece towards the bell, in other words said edges of the said channel are closer to one another at the face of the instrument mouthpiece than in the end zone of the channel and conversely, for the same channel, for the other face of the windchest against which presses the other reed plate, the longitudinal edges of said channel gets closer on the whole to one another when one moves away from the instrument mouthpiece towards the bell, in other words said edges of said channel are more distant from one another at the face of the instrument mouthpiece than in the end zone of the channel.

In addition, such an arrangement allows either to favor the aptitude of the instrument to produce the natural basic notes of each reed with the flows of drawn air or blown air corresponding to their specificity or on the contrary to favor the aptitude of the instrument to produce the so-called "accidental" notes requiring to make the sound reeds vibrate with the flows of drawn air or of blown air in a direction opposite those corresponding to their specificity.

Thus, in order to specialize the instrument above all in producing the natural basic notes, the reed plate supporting the draw reeds will then be pressed against the face of the windchest in which, for each of the channels considered, the longitudinal edges of said channel are closer to one another at the face of the mouthpiece than near the bottom of the channel and the reed plate supporting the blow reeds will be then pressed against the face of the windchest in which, for each of the channels considered, the longitudinal edges of said channel are more distant from one another at the face of the mouthpiece than near the bottom of the channel.

Conversely, if one wishes to find a compromise allowing to obtain of course the natural notes of the reeds but however in a less stable way than in the above-mentioned assembly while facilitating on the other hand the production of the so-called "accidental" notes, it will be sufficient to make a symmetrically reversed windchest with respect to the average longitudinal plane Px of said windchest in such a way that, for the reed plates supporting the blow reeds, for each channel considered, the longitudinal edges of said channel are closer to one another at the face of the mouthpiece than near the opposite end of the channel and the reed plate supporting the draw reeds will then be pressed against the face of the windchest in which, for each channel considered, the longitudinal edges of said channel are more distant from one another at the face of the mouthpiece than near the opposite end of the channel.

According to another feature of a particular embodiment, the mouthpiece hole of at least some channels comprises a wing whose average plane substantially positioned half the width of said hole is perpendicular to the average longitudinal plane of the harmonica. This wing extends towards the inside of the channel from the immediate vicinity of the face of the instrument mouthpiece and it has the shape of a drop of water for avoiding the turbulences of the flows of drawn or blown air. It is meant to split said flows of drawn and blown air on the one hand, in case of flows of blown air, for limiting as best as possible the inopportune exhaust of the blown air through the zone of the aspired window left wide open by the opening of the draw reed when the latter is at rest and on the other hand, in the case of flows of drawn air, for channeling the flows of drawn air towards the lateral edges of the draw reed in order to optimize the required localized depression at the end of the draw reed for said flows of drawn air.

According to another feature, at least some channels comprise a longitudinal internal wall substantially parallel to the average longitudinal plane Pm connecting to one another two adjacent lateral separating walls for the channels and said longitudinal wall is configured as a tapered wing for generating, by Venturi effect, a depression at the free end of the draw reed for closing again the window concerned in order to avoid leaks of blown air when the player blows for making the blow sound reed of the channel concerned vibrate.

According to another preferential embodiment, the harmonica comprises only one reed plate on which all the blow reeds and all the draw reeds are mounted. Each air flow channel supplies at least one blow reed and one draw reed. The two reeds supplied by the same air channel are disposed in line on both sides of the reed plate concerned and their respective longitudinal axes are coplanar with the longitudinal axis of said air channel while said oscillating free parts of said two sound reeds extend in two diametrically opposite directions relative to one another. The draw reed is fixed against the external face of the reed plate, thus against the face of the reed plate on the side of the corresponding cover plate while the blow reed is fixed against the face of said reed plate pressed against the windchest. The fixed end of each of the two reeds can be fixed and maintained against the reed plate either by a welding, sticking or riveting process or better by using only one screw common to both reeds or by using several screws common or not to both reeds.

According to a feature of a particular embodiment, in logical correlation with the respective amplitudes of oscillations of the free end of each sound reed, which is directly linked to the respective lengths of said sound reeds, the thickness of at least one of the reed plates of the harmonica is advantageously more reduced at the high-pitched sound reeds than at the low-pitched sound reeds.

According to another feature of a particular embodiment, the harmonica comprises two reed plates, each supporting only one type of sound reeds, blown or drawn, and the arrangement of said reed plates is reversed with respect to the traditional arrangement in which, when the instrument is in the position of play and, with respect to the harmonica player, the low-pitched reeds are located on his/her left and the high-pitched reeds are located on his/her right, the reed plate supporting the draw reeds is disposed in the lower part of the instrument while the reed plates supporting the blow reeds is disposed in the upper part of the instrument. In the reversed arrangement suggested, the reed plate supporting the draw sound reeds is thus disposed against the upper face of the comb while the reed plates supporting the blow reeds is disposed against the lower face of the comb. This reversed arrangement makes it possible to greatly facilitate the evacuation of saliva and very small detritus directly towards the outside of the instrument whereas, in the traditional arrangement, those are trapped in the dead end formed by the bottom of the channel they cannot leave because of the closed zone having the form of an acute angle and formed by the fixed part of the draw reed disposed in the lower part of the channel concerned. Conversely, the reversed arrangement suggested makes it possible to easily evacuate said detritus towards the outside through the window in the reed plate in which oscillates the free part of the blow reed concerned which is disposed in the lower part of the instrument and this evacuation towards the outside is all the more efficient since it is ensured by the combined self-cleaning effect of gravity, the vibrations of the blow reed and the flows of blown air.

According to another feature for at least some windows in the reed plates, in the part of the window through which the free part of the sound reed extends when oscillating, the thickness of the reed plate presents thickness variations having the shape of stairs, and/or crenels and/or waves and/or any other forms.

These height variations of the lateral faces of the window can be located in the face of the reed plate on the air input side, thus in the face of the reed plate against which the sound reed is fixed, as well as in the opposite face on the air exhaust side. These thickness variations can be hollow variations as well as raised variations with respect to the general plane passing through the face concerned of the reed plate and they can be made locally in an individual way for each window as well as by longitudinal shaping of the reed plate.

These arrangements in the side faces of the windows allow multiple successive phase shifts between the openings and closings of the window by the free part of the sound reed when oscillating, which openings and closings result in a complex chopping of the air flow through said window, thus generating multiple harmonics favorably enriching the pitch of the emitted note.

According to another important feature of a particular embodiment, the harmonica according to the invention comprises at least one ventilation tunnel allowing a free movement of the air and the sound directly between the space on the side of the instrument mouthpiece and at least one of the two internal volumes in the harmonica delimited by the internal face of the cover plate concerned and the external face of the corresponding reed plate. This direct air and sound flow tunnel, which does not thus comprise any sound reed on its way, is arranged in at least one part, if not in the totality, of the thickness of the comb and one of its two ends in the mouthpiece face of the instrument, and even directly in the mouthpiece face of the instrument, while its other end ends in the internal volume in the harmonica body between the reed plate concerned and the internal face of the corresponding cover plate.

For the harmonica players who place their instruments in a classical way, i.e. in such a way that, when they are playing, the low-pitched reeds are positioned on the left and the high-pitched reeds are positioned on the right, the above-described ventilation tunnel will be advantageously designated by Channel 0 insofar as it is positioned on the left of Channel 1 supplying the most low-pitched reed of the instrument unlike Channel 10 supplying the most high-pitched sound reed for a traditional diatonic harmonica comprising ten mouthpiece holes.

According to a preferred embodiment, the zone of the mouthpiece face of the instrument, in which ends the input of the above-described ventilation tunnel, is arranged either in the rectilinear prolongation of the mouthpiece face in which ends the mouthpiece holes of the instrument, but said zone can also be advantageously shifted or disposed obliquely with respect to the mouthpiece face of the instrument in which ends the air channels supplying the sound reeds so as to clear in a better way the input of said ventilation tunnel when the player's mouth is positioned opposite the mouthpiece holes supplying the low-pitched reeds of the instrument.

According to a first embodiment, the harmonica comprises at least one ventilation tunnel is selectively intended to only one of the two reed plates supplemented, if necessary, with a second tunnel selectively intended to the second reed plate.

According to another preferential embodiment, the ventilation tunnel ends both in the two reed plates in such a way that the two internal volumes of the harmonica, located on both sides of the comb and classically separated from one another by the comb, can thus communicate with one another via the ventilation tunnel serving these two internal volumes.

This or these ventilation tunnel(s) aim(s), first of all, at ensuring an optimal air supply of the low-pitched reeds and in particular the low-pitched draw reeds which are penalized by the remote position from the bell of the ends of their windows the flows of drawn air must pass through, said ends of the window being very close to the mouthpiece in a dead end formed by the corresponding internal face of the cover plate and the reed plate concerned.

Secondly, this or these ventilation tunnel(s) aim(s) at allowing a better diffusion of the sounds emitted by the various sound reeds towards the outside of the instrument and, thirdly, they aim at enabling the harmonica player to better hear the sounds emitted by his/her instrument, in particular when he/she plays in a group and the sounds emitted by his/her harmonica are covered by those produced by the other musicians. To optimize the efficiency of said ventilation tunnel concerning this last objective, a tube intended to lead the sounds emitted by the harmonica can advantageously be connected to the input of the ventilation tunnel in order to form an acoustic tube, the first end of said acoustic tube being connected to the input face of the ventilation tunnel, thus on the side of the mouthpiece face of the instrument, while the other end of this tube is connected to an earphone inserted into the player's ear.

Lastly, according to another feature of a particular embodiment intended, on one hand, to make a sufficient space for placing the input of the ventilation tunnel between the mouthpiece hole supplying the most low-pitched reed of the instrument and the end near the instrument and on the other hand to facilitate, and make it more comfortable, the technique of play known by the man skilled in the art as "Tongue blocking", the axis of the mouthpiece hole supplying the most low-pitched reed of the instrument is located at a distance from the corresponding longitudinal end of the mouthpiece face superior to the distance where the axis of the mouthpiece hole supplying the most high-pitched reed of the instrument is positioned with respect to the corresponding longitudinal end of said mouthpiece face.

According to another feature of a particular embodiment, the mouthpiece face of the instrument is slightly convex in the longitudinal direction of the instrument for allowing a lower pressure of said mouthpiece face against the corner of the mouth while maintaining a position of the sound reeds with respect to the player's oral cavity which is identical to that obtained with the traditional rectilinear mouthpiece faces.

BRIEF DESCRIPTION OF THE DRAWINGS

Other advantages and features will more clearly arise from the following description of various embodiments given as nonrestrictive examples and represented in the annexed drawings in which:

FIGS. 1 to 14B correspond to a first embodiment of a harmonica according to the invention whose general external shape is on the whole symmetrical and which comprises two reed plates, FIGS. 15 to 26B show a second embodiment of a harmonica according to the invention having an asymmetrical external shape and comprising two reed plates, FIGS. 50 to 53B show arrangements according to the invention for a harmonica of the chromatic type comprising a sliding air distributor.

DESCRIPTION OF VARIOUS EMBODIMENTS

Figures 1, 2, 3:
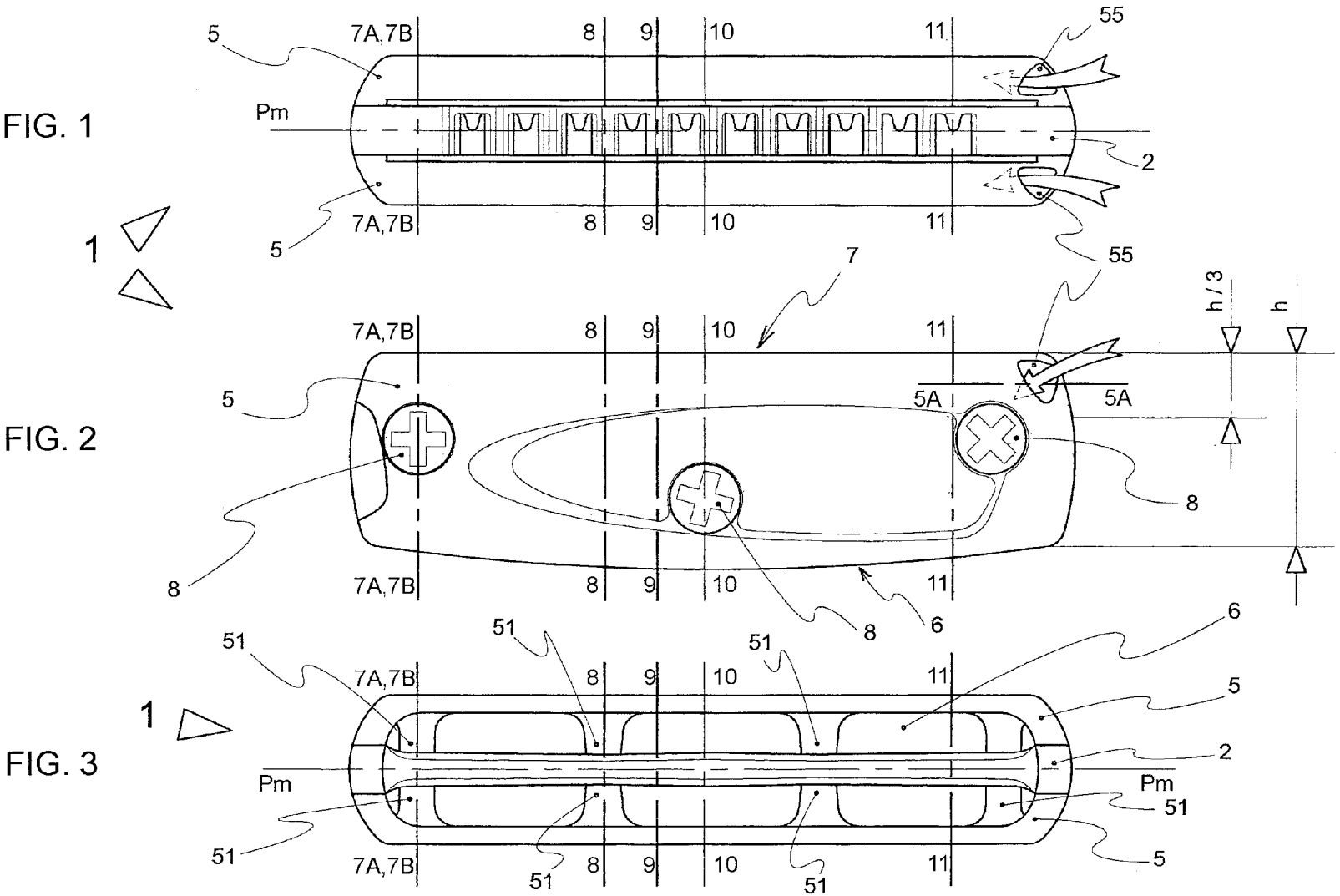

Before the following explanations, it is important to specify that, to make the drawings more readable and more explicit, in some Figures in this document, the thicknesses of the reed plates as well as those of the sound reeds have been intentionally magnified with respect to the real thickness. In the same way, the lateral plays between the lateral edges of the sound reeds and the corresponding edges of the windows through which they oscillate as well as the plays between the end of said plates and the corresponding section of said windows, which are in reality about 5 to 10/100 of millimeters, have been largely magnified here to facilitate the comprehension of the drawing.

Figure 6:
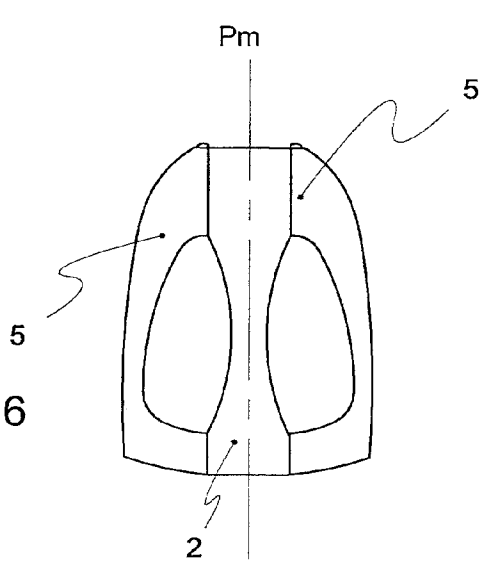
Figure 12:
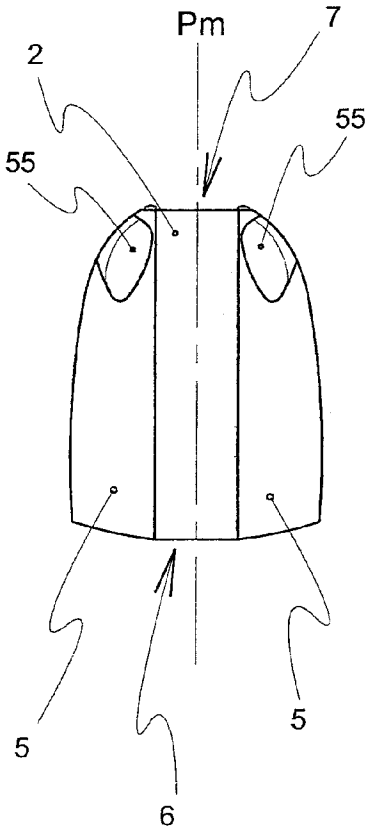
Figure 11:
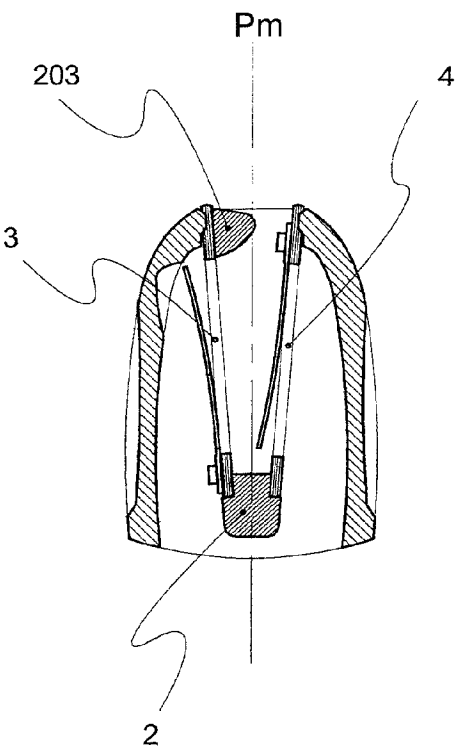
Figure 10:
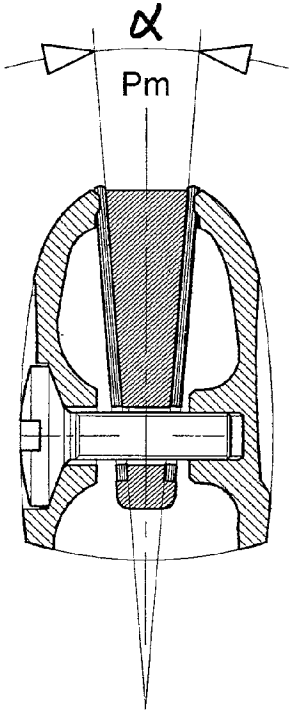
Figure 9:
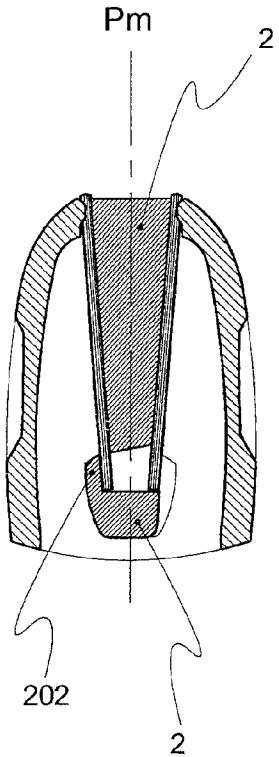

FIGS. 1, 2, 3, 6 and 12 are external views of the harmonica entirely assembled, respectively a top view, on the mouthpiece side of the instrument, a front view and a bottom view, therefore on the bell side of the instrument, while views 6 and 12 correspond to side views of the instrument, FIG. 6 showing the end of the harmonica on the high-pitched reed side of the instrument while FIG. 12 shows the end of the harmonica on the low-pitched reed side.

Figure 4:
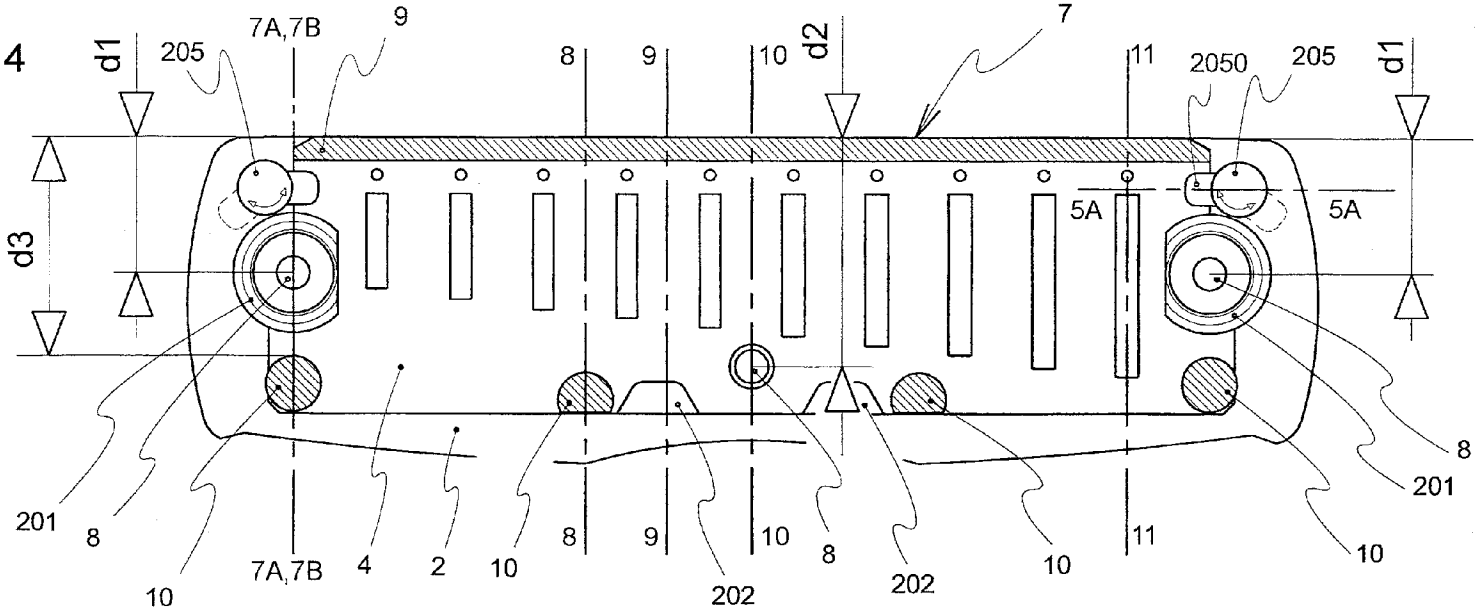

FIG. 4 is a front view of the instrument after removal of the cover plate covering the reed plate supporting the blow reeds.

Figure 5B:
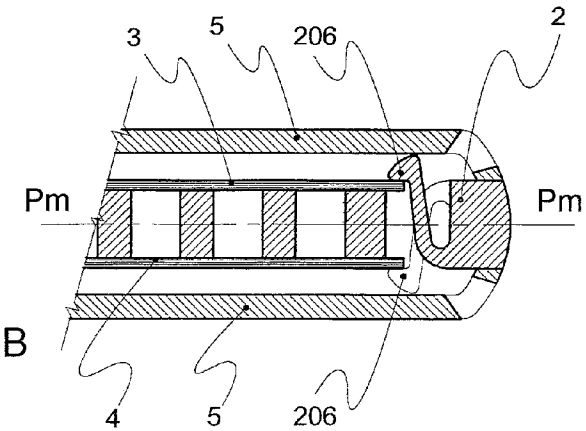
Figure 5A:
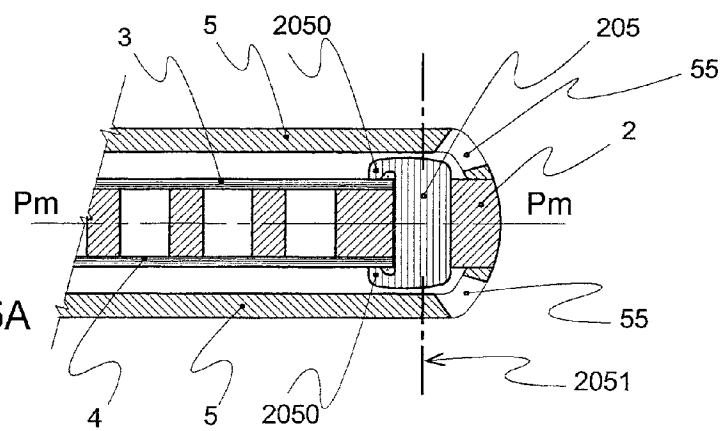

FIG. 5A is a cross-section according to reference marks 5A in FIGS. 2 and 4 showing a first embodiment of the means of pressing and immobilizing the reed plates against the comb when the pressing cover plates are dismounted and FIG. 5B is a cross-section showing an alternative embodiment of these means of pressing and immobilizing.

FIGS. 7A, 7B, 8, 9, 10 and 11 are cross-sections according to corresponding reference marks in FIGS. 1 to 4.

Figures 13, 14A, 14B:
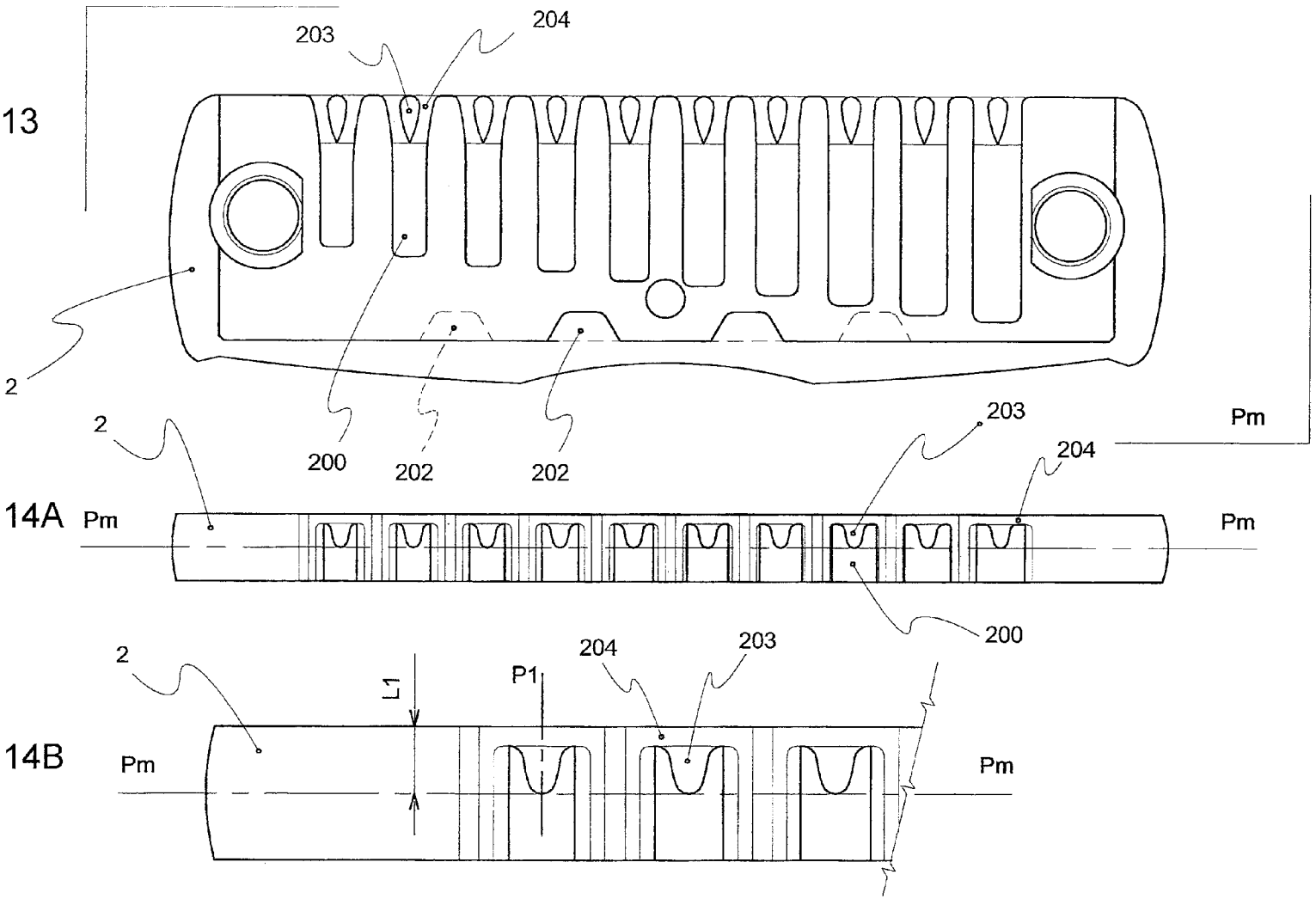

FIGS. 13, 14A are respectively front and top views showing the comb alone while FIG. 14B shows an magnification of a part in FIG. 14A.

This being specified, in views 1 to 14B, the harmonica 1 comprises:

a comb 2 or windchest in the thickness of which are made a plurality of air flow channels 200 disposed side by side while being separated from one another by lateral walls disposed transversely, thus perpendicularly, to the longitudinal axis of the instrument, one of the end faces of each of said separating walls pressing against the internal face of the reed plate 3 on the external face of which are assembled the draw sound reeds while the other end of said separating wall presses against the internal face of the second reed plate 4 against which are mounted the blow sound reeds. The reed plates 3 and 4 are disposed obliquely to one another, the planes passing through their respective pressing faces against the corresponding pressing faces of the comb 2 formant here a dihedron open towards the mouthpiece face of the instrument by forming an angle $\alpha$ superior to 0° and advantageously between 3 and 10°, preferably between 4 and 7°.

a peripheral shell allowing to hold the harmonica by hand, said shell being in particular made up of two pressing cover plates 5 and 5 ensuring on the one hand the amplification of the sounds and the projection thereof towards the bell 6 of the instrument, and on the other hand the pressing of the reed plates 3 and 4 against the corresponding faces of the comb 2.

a mouthpiece face 7 in which ends the mouthpiece holes through which the harmonica player draws or blows the air making the sound reeds of the instrument vibrate, each mouthpiece hole ending in at least one air flow channel 200 supplying at least one sound reed.

Figure 7B:
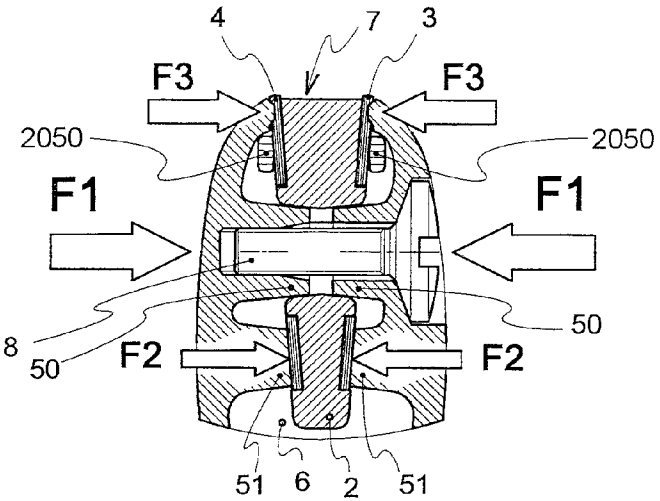
Figure 7A:
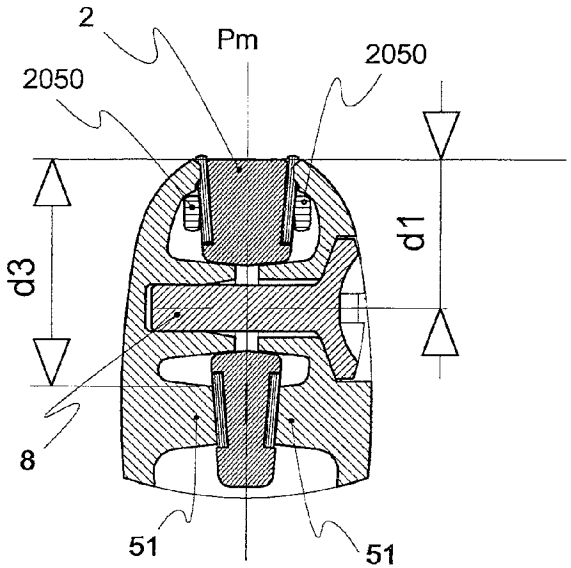
Figure 8:
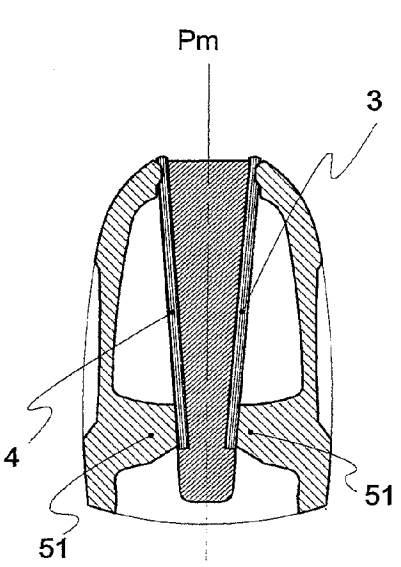

FIGS. 4, 7A and 7B show the operating principle of the pressing cover plates 5 and 5 positioning and pressing the draw reed plates 3 and the blow reed plates 4 against the corresponding faces of the comb 2.

Each of the two reed plates 3 and 4 is placed against the comb by being first slid vertically into the lower hooks 202 firmly fixed to the comb 2, then folded back against the corresponding lateral face of the comb 2, each of the two holes in the end zones of the reed plate being fitted around a projecting element 201 of complementary shape, made up here of a projecting flange with respect to the pressing face of the comb with which said flange forms a monolithic unit here.

When the two reed plates 3 and 4 have been thus placed, the two pressing cover plates 5 and 5 are also correctly positioned by means of tubular centering nipples 50 and 50 forming a monolithic unit with the cover plate concerned, each of said nipples being placed into a hole of complementary shape through the comb 2. In the embodiment illustrated in FIGS. 7A and 7B, the centering nipples 50 are placed concentrically with the corresponding press-screw 8 but it is also possible to dissociate the pressing means from the means for ensuring, on the one hand, the good positioning of the cover plates with respect to the comb and for avoiding, on the other hand, the reversal of the cover plates during the assembly. Thus, these means of positioning can be formed by nipples firmly fixed to the cover plate placed into housings of corresponding shape in the comb or, on the contrary, by nipples firmly fixed to the comb placed into housings of complementary shape in the corresponding cover plate.

Each of the two pressing cover plates 5 and 5 presses against the external face of the reed plate concerned 3, 4 on the one hand, on the mouthpiece side 7 of the instrument, via its upper lip all along the upper zone of the reed plate extending in the longitudinal direction of the instrument on the side of the mouthpiece face and represented by a hatched zone 9 in FIG. 4 and on the other hand, on the bell side 6 of the instrument, via pressing tabs 51 firmly fixed to the cover plate concerned and pressing directly on the external face of the reed plates in zones, represented by hatched zones 10 in FIG. 4, positioned in the lower part of said reed plates.

The two pressing cover plate 5 and 5 are then pushed towards the comb by pressing means, which are formed here by three press-screws 8 inserted between the mouthpiece face 7 of the instrument and the pressing tabs 51 on the bell side 6 of the instrument. These three screws 8 extend through the cover plate 5 on the draw reed side then through the two reed plates 3 and 4 as well as the comb 2 and are finally screwed into the opposite cover plate 5 on the blow reed side.

According to an important feature, the axes of the press-screws 8, which forms the pressing means here, are located at distances d1 and d2 from the mouthpiece 7 inferior to the distance d3 separating said mouthpiece face 7 from the upper edge of the pressing zones 10, which upper edge thus corresponds to the upper edge, therefore to the edge oriented towards the instrument mouthpiece, of the contact zone between the pressing tab 51 concerned and the corresponding face of the reed plate. It is necessary to stress the importance of the screw 8 which is place half the length of the instrument aligned with the longitudinal axis of the comb wall separating the channels from the two sound reeds on both sides of the plane passing through half the length of the instrument perpendicular to the average longitudinal plane Pm of the instrument.

As the cover plates 5 and 5 has a rigid structure so that they cannot get deformed under the effort, by cantilever effect, the pressing forces in the direction of F1, generated by these screws 8 for bringing said cover plates nearer against the comb 2, result both, at the pressing tabs 51, in a force exerted on the zones 10 in the direction of F2 and in a force exerted in the direction of F3 distributed all along the contact zone 9 between the upper lip of the cover plate and the corresponding face of the reed plate concerned. Each of the two reed plates 3 and 4 is thus sandwiched between the corresponding cover plate and the face concerned of the comb 2 under the important pressing forces enabling to press the internal faces of the reed plates 3 and 4 perfectly against the corresponding external face of the comb 2, which thus enables an optimal air-tightness.

FIGS. 13, 14A and 14B show in more detail the comb 2 of the harmonica represented on the preceding Figures.

In this embodiment, at the mouthpiece face of the instrument, all the mouthpiece holes forming the input holes of the air flow channels have the same width but the respective widths of said air flow channels then decrease from the low-pitched register to the high-pitched register in a coherent way with respect to the respective dimensions of the various reeds decreasing from the low-pitched register to the high-pitched register.

In their upper part, from the mouthpiece face 7 of the instrument, the lateral walls separating two contiguous channels are connected to one another by a connection wall 204 parallel to the average longitudinal plane Pm of the instrument so that, in their upper part, the air flow channels 200 in this comb 2 are thus closed on three of their sides while they are then open on their two sides and extend through the totality of the comb thickness in their lower part. The connection wall 204 supports a wing 203 whose median plane P1 is coplanar with the median longitudinal plane of the channel 200 concerned, said plane P1 being thus perpendicular to the average longitudinal plane Pm of the harmonica. This wing 203, having advantageously the shape of a water drop in a front view such as represented in FIG. 14A, divides the flows of drawn and blown air both for enabling a better flow of the blown air towards the free end of the blow reed and for increasing the depression generated at the longitudinal edges of the free part of the draw reed during drawn flows. As represented in these Figures, the length L1 of said wing is inferior to the half-thickness of the comb 2 so that its end is in the vicinity of the average longitudinal plane Pm of the harmonica but it could be otherwise, the length L1 could be such that said wing extends through the channel on all its thickness.

As represented in these FIGS. 14A to 14B, the connection wall 204 is disposed on the side of the draw reed plates 3, favoring the operation of the draw and blow sound reeds when vibrating because of a flow of air, respectively drawn or blown, corresponding to their main mode of use but it is also possible to reverse the position of said wing and the connection wall supporting it by disposing then said wall on the side of the blow reed plates 4 in order to intentionally make the air flow more unstable so as to make the draw and blow sound reeds vibrate because of the reversed air flows, thus respectively blown and drawn, for producing accidental notes or overblown or overdrawn notes with the particular pitches sought in some types of music.

FIGS. 4 and 5A moreover show that the harmonica according to the invention comprises means for positioning and pressing the reed plates 3 and 4 against the comb 2 when the pressing cover plates 5 and 5 have been removed. These means are formed here by a U-shaped double hook 205 extending through the comb 2 right through its thickness and able to swivel about an axis 2051 concentric with the cylindrical central part of the hook 205, said axis 2051 being positioned perpendicular to the average longitudinal plane Pm of the instrument. The double hook 205 can thus swivel about the axis 2051 so as to pass from a removed position in which its pressing pins 2050 and 2050 are not in contact with the reed plates, such as represented by a dotted line in FIG. 4, to a placed position, represented by a full line in FIG. 4 and in FIG. 5A, in which said pins 2050 and 2050 press against the corresponding external face of the reed plates concerned in order to press and immobilize said reed plates against the corresponding face of the comb 2, said comb 2 being thus sandwiched between the two reed plates 3 and 4.

FIG. 5B shows an alternative embodiment in which the means for maintaining in position and immobilizing the reed plates 3 and 4 when the pressing cover plate are dismounted are formed by two hooks 206 and 206 directly in the mold when making the comb with which they thus form a monolithic unit. These hooks can be slightly folded up by a simple elastic flexion in order to place the reed plates against the external face of which said hooks then presses once the reed plates are correctly positioned. As represented in this FIG. 5B, the face of the hooks oriented on the side of the reed plate concerned have advantageously the shape of a convex curvilinear ramp so that the hook can be automatically removed like a cam nose of a door when the corresponding edge of the reed plate concerned slides against said ramp. Of course, a simple pressure exerted by the finger towards the outside against said curvilinear face makes it possible to release the reed plate at once when the player desires to dismount it from the comb against which it was pressing.

As it is shown in FIGS. 2 and 12, air intake sound holes 55 are arranged at the end of the cover plates 5 and 5 on the side of the low-pitched reeds, said sound holes being located at least partially, if not advantageously entirely, in the upper third higher h/3 of the height h of the cover plates in order to be inserted outside the zone of the cover plates covered by the hand of the harmonica player holding the instrument.

Figures 15, 16, 17, 18, 19, 20:
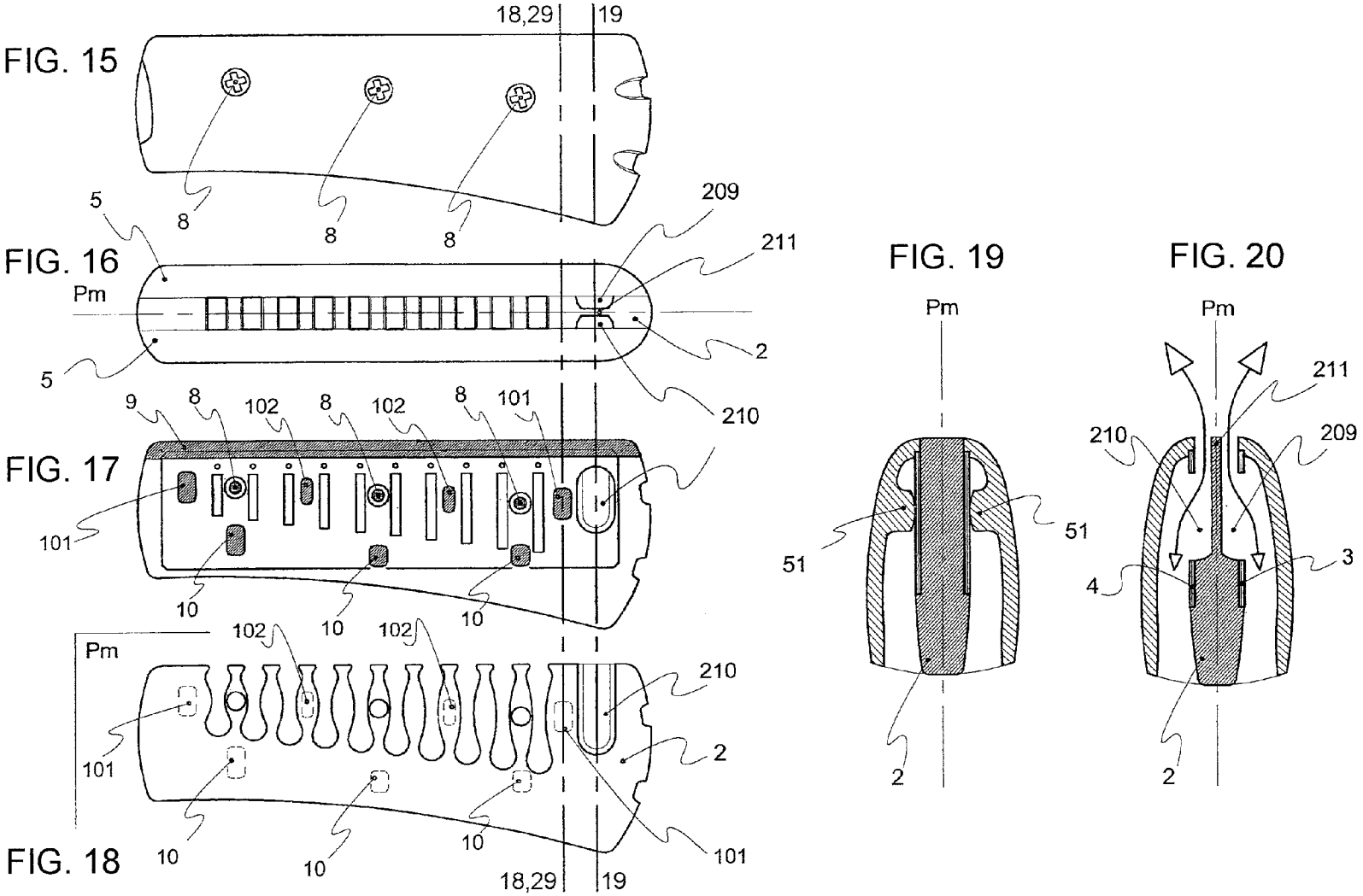

FIGS. 15 to 26B show another embodiment of a harmonica having an asymmetrical shape in a front view as represented in FIGS. 15 and 21, the distance from the mouthpiece face to the mouthpiece hole corresponding to the most low-pitched reed of the corresponding opposite face forming the bell of the instrument being superior by more than twenty percent (20%) to the distance from the mouthpiece face to the mouthpiece hole corresponding to the most high-pitched reed of the corresponding opposite face forming the bell of the instrument. Such an asymmetrical shape is particularly interesting on the one hand in that it is ergonomically optimal for holding the instrument in only one hand while limiting the weight of the part of the instrument.

Such an ergonomic asymmetrical shape is particularly interesting in that on the one hand the volume and the weight of the instrument are concentrated in the hand holding both the harmonica between thumb and index and the microphone with the other fingers and on the other hand the height of the part of the harmonica on the side of the high-pitched reeds is reduced, which facilitates the various actions of the second hand for producing effects modifying the sounds emitted by the instrument.

FIGS. 18 and 24 show that the channels have the general shape of an 8, each of said channels comprising at the free end of the draw reed a wide room 207 having a substantially circular shape with a width L2 and another wide room 208 having also a substantially circular shape with a width L2, but whose width could also be different from L2, at the free end of the blow reed while the sides of the channel connecting said rooms 207, 208 have convex curvilinear shapes so that the width L3 of said channel measured near its half-length is inferior to the width L2 of the channel measured at the free end of the draw sound reed and also inferior to the width L2 of the channel measured at the free end of the blow sound reed supplied by said channel.

Such an arrangement has several advantages, notably that of having lateral walls separating the channels from one another with a sufficient width half the length of said channels in order to be able to insert the press-screws 8 of the pressing cover plates 5 and 5 closer to the mouthpiece face than it is possible with the prior art combs whose said separating walls of the channels are too narrow to allow to make a hole with a sufficient diameter for the passage of a solid press-screw.

As it is shown in FIG. 24, this design makes it possible to insert the press-screws 8 of the pressing cover plates 5 at distances, respectively d5, d6, d7, from the mouthpiece face of the instrument which all are inferior to the distance d9 separating said mouthpiece face from the bottom of the channel supplying the most high-pitched reeds of the instrument. As it is also shown in these two FIGS. 18 and 24, three press-screws 8 distributed along the instrument and all inserted between the sound reeds are sufficient to perfectly press the two pressing cover plates 5 and 5 without using screws in the end zones of the instrument where they appear disadvantageous for the openings in the sides of the cover plates for a better sound dispersion and an optimal air supply of the reeds.

The harmonica in FIGS. 15 at 20 comprises two ventilation tunnels 209 and 210 symmetrically disposed on both sides of the average longitudinal plane Pm of the instrument, the two tunnels 209 and 210 being separated from one another by a wall 211 symmetrically disposed with respect to the place Pm.

As it is notably shown in FIG. 18, these tunnels are rectilinear and their longitudinal axis extends here parallel to the longitudinal axis of the sound reeds. The input of the tunnels 209 and 210 is located in the plane of the mouthpiece face in which ends the mouthpiece holes of the air channels supplying the sound reeds and this input of the tunnels 209 and 210 is positioned between the mouthpiece hole, generally designated by hole number 1, supplying the most low-pitched reed of the instrument and the nearest corresponding longitudinal end of the instrument.

The tunnels 209 and 210 pass then between the internal face of the reed plate concerned, respectively 3 and 4, and the comb 2, and then pass through a window in said reed plate so as to end in the internal space delimited by the internal face of the cover plate 5 and the external face of the draw reed plate for the tunnel 209 while the tunnel 210 ends in the space delimited by the internal face of the cover plate 5 and the external face of the blow reed plate 4. These two tunnels, connecting the internal of the harmonica with the external space on the mouthpiece side, thus allow on the one hand an optimal air supply of the reeds, very interesting in particular in the case of the draw reeds, and on the other hand a maximum diffusion of the sounds emitted by the instrument since, as it is known, the sound passes where the air passes.

In addition, as it is shown in FIGS. 15, 17 and 18, this harmonica comprises three press-screws 8 for the cover plates and, via the pressing tabs 51, for the pressing cover plate 5 concerned, each of these three screws 8 exerts on the reed plate concerned a pressing force on four distinct zones around said screw and represented in shaded zones: on the one hand, a pressing zone 9 on the mouthpiece face of the instrument and a diametrically opposite pressing zone 10 on the bell side of the instrument and on the other hand two pressing zones 101 and 102, or 102 and 102 for the central screw, on both sides of said the screw in the longitudinal direction of the instrument. It follows therefrom that the reed plate concerned is thus maintained firmly against the comb by a multitude of pressing zones guaranteeing a maximum airtightness between said reed plate and the comb, on the side of the periphery of said reed plate as well as on the side of the separating walls for the channels.

FIGS. 21 to 26B show another embodiment of a harmonica according to the invention comprising a ventilation tunnel 212 simultaneously serving, by connecting them, two internal volumes in the harmonica delimited, for one of them, by the internal face of the cover plate 5 and by the external face of the draw reed plate 3 and, for the other, by the internal face of the cover plate and the external face of the blow reed plate 4. The longitudinal axis of the tunnel 212 is oriented obliquely or can even be parallel to the mouthpiece face with respect to the mouthpiece face of the instrument by forming an angle β inferior to 90° (ninety degrees) and thus advantageously between 0° (zero degree) and 60° (sixty degrees), preferably between 15° (fifteen degrees) and 45° (forty five degrees) and the input of said tunnel 212 ends in the small face also oriented obliquely with respect to the mouthpiece face of the instrument both in order to allow an optimal flow of the air and the sounds and to permanently clear the input of the tunnel 212 even when the player's mouth is on the mouthpiece hole of the channel supplying the most low-pitched reed of the instrument.

In addition, FIGS. 26A and 26B show that a flexible acoustic tube 500 is connected to the input of the tunnel 212 which is on the mouthpiece face side of the instrument and which it can completely or, on the contrary, only partially take up so as to be able to form then an air intake for the reed plates 3 and 4. At its other end, this acoustic tube 500 is connected to an end having the shape of an earphone inserted into the player's ear so that he/she can better hear the sounds emitted by his/her own instrument when he/she plays in a group of harmonica players or when he/she is accompanied by other instruments.

Figure 27:
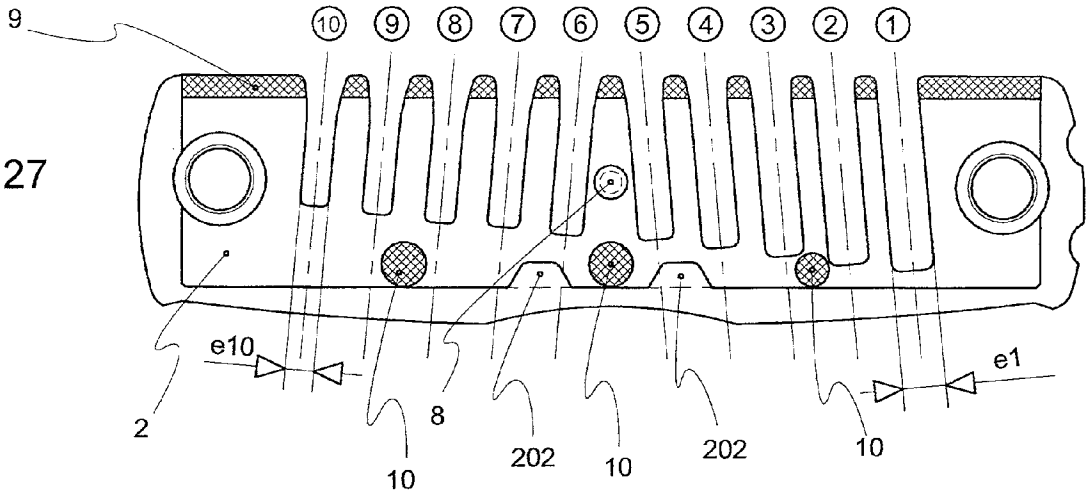
FIGS. 27 and 28 show two embodiments of a comb whose channels have longitudinal axes which are not all parallel to one another.
Figure 28:
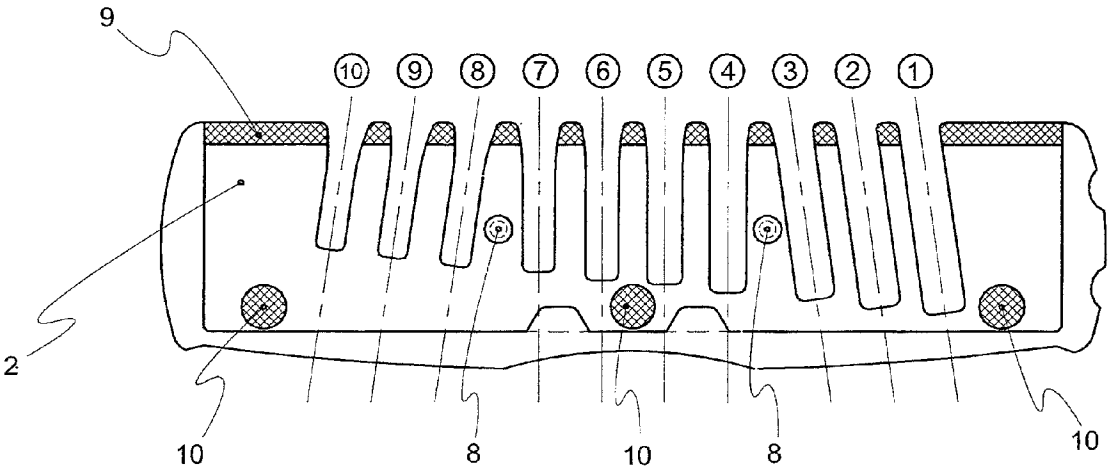
Figure 30:
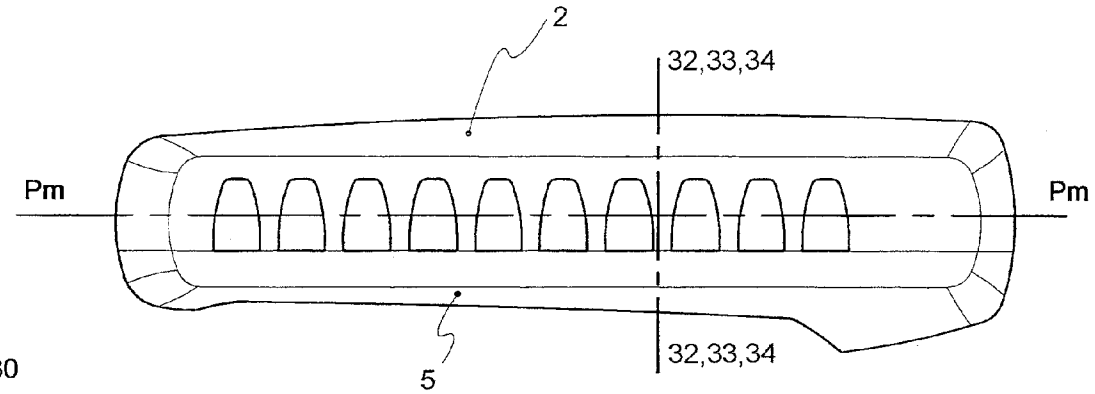
FIGS. 29 to 34 show another embodiment of a harmonica according to the invention having an asymmetrical external shape and comprising only one reed plate and whose air flow channels are not all parallel to one another.
Figure 31:
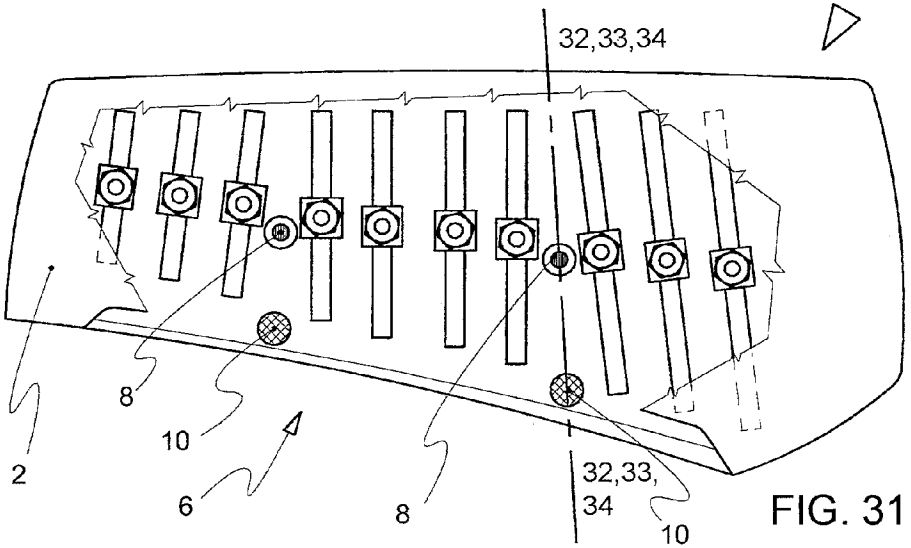
Figure 29:
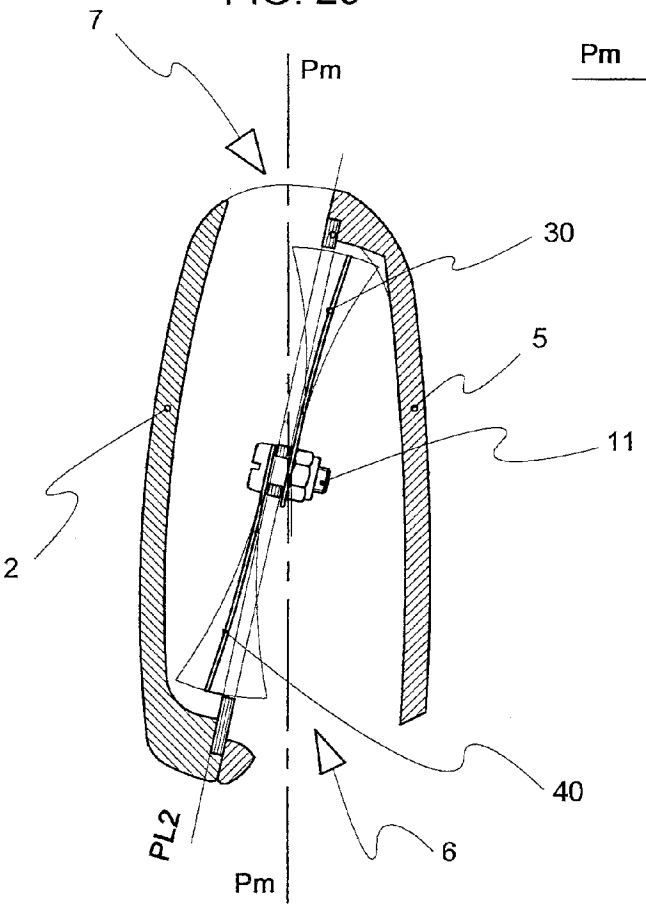

The embodiments illustrated in FIGS. 27 and 28 show combs whose mouthpiece holes are regularly distributed according to traditional center distances of axes on the mouthpiece face side of the instrument but the longitudinal axes of some air flow channels are divergent when one moves away from the mouthpiece face towards the instrument bell so as to have separating walls for channels with a sufficient width for inserting one or several press-screws 8 for the cover plates as near as possible to the mouthpiece face in order to optimize the pressing cantilever effect all along the mouthpiece face in order to avoid air leaks between the comb, the reed plates and the cover plates.

In FIG. 27, the ten air flow channels in the instrument are divided into two groups: the longitudinal axes of the first five channels forming the first group are parallel to one another and the longitudinal axes of the last five holes forming the second group are parallel to one another. The longitudinal axes of the channels of the first group are divergent with respect to the longitudinal axes of the channels of the second group so that the wall separating the channel 5 from the channel 6 is sufficiently wide to insert the press-screw 8 substantially at the center of the harmonica, therefore substantially half the length and half the height of the instrument so that sufficiently rigid cover plates allows a sufficient airtightness of the instrument by using only one central screw, which allows to dismount and mount again the instrument very quickly.

In FIG. 22, the air flow channels are divided into three groups in which the longitudinal axes of said channels are parallel to one another and the wall separating the channel 3 from the channel 4 and the wall separating the channel 7 from the channel 8 are sufficiently wide to allow the insertion of the press-screws 8 half the length of said channels or at the very least so that the axis of each press-screw 8 is positioned nearer to the mouthpiece face 7 than the bottoms of the air flow channels are on both sides of the press-screw concerned.

One can thus say that FIGS. 21 and 22 illustrate two embodiments in which the harmonica according to the invention comprises at least one press-screw 8 for the pressing cover plates 5 positioned in a wall separating from one another two adjacent air flow channels whose respective longitudinal axes are divergent when one moves away from the mouthpiece face 7 of the instrument towards the instrument bell 6. One can also see that the longitudinal axis of said press-screw 8 is positioned at a distance from the mouthpiece face 7 of the instrument inferior to the distances separating said mouthpiece face from the bottoms of the air flow channels adjoining the wall in which is inserted the above-mentioned press-screw 8.

FIGS. 29 to 34 show a particular embodiment in which all the sound reeds in the instrument are supported by only one reed plate and, over all their length, the air flow channels are closed on three of their longitudinal faces formed by the comb 2. For each air channel, the longitudinal axis of the draw reed 30 is aligned with the longitudinal axis of the blow reed 40 and the two reeds, disposed head to foot on both sides of the reed plates, are fixed to the reed plates by only one common screw 11. The single reed plate is tilted in the plane P2 with respect to the average longitudinal plane Pm.

Figure 33:
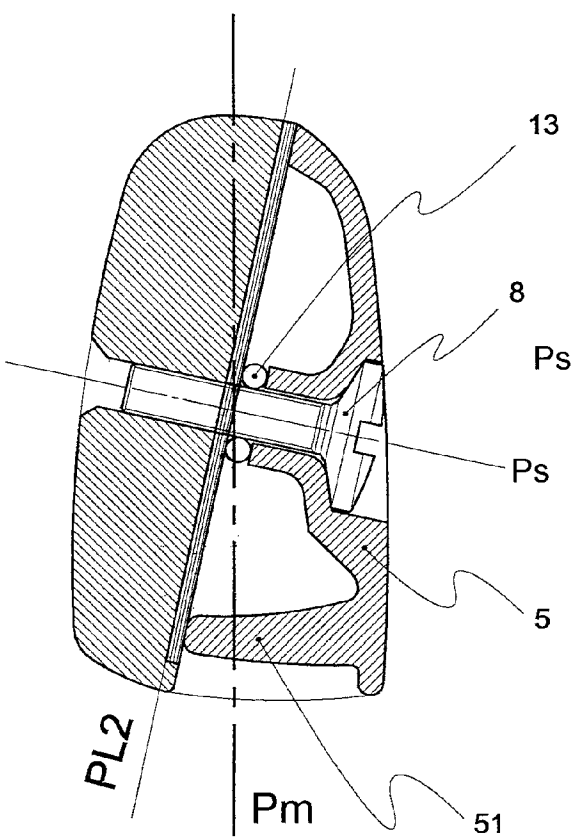
Figure 32:
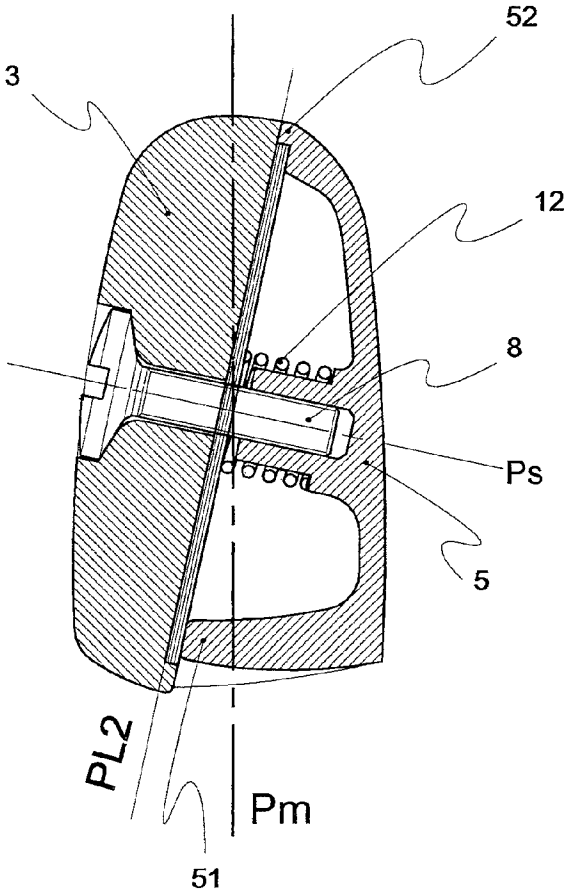
Figure 37:
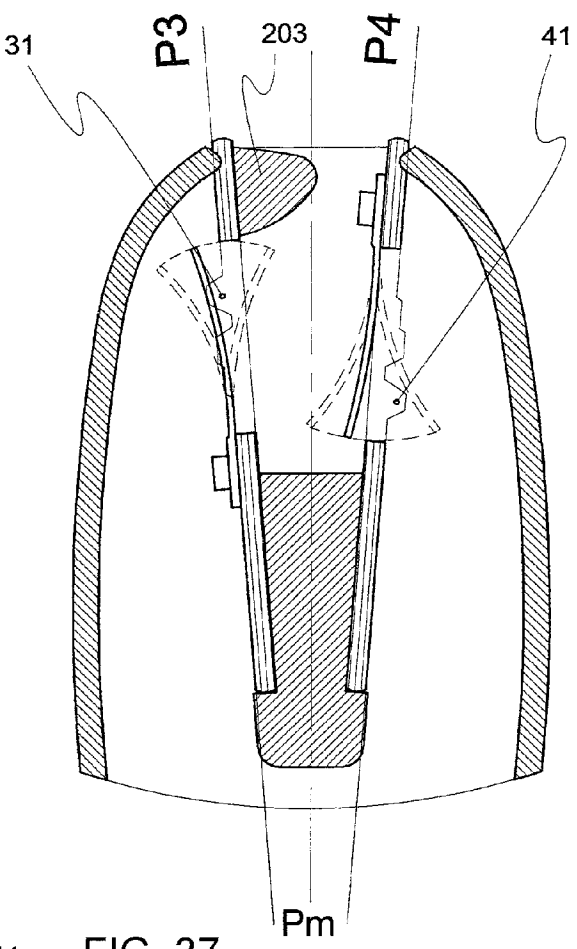
FIGS. 35 to 49 show particular arrangements of reed plates for a harmonica according to the invention.
Figure 36:
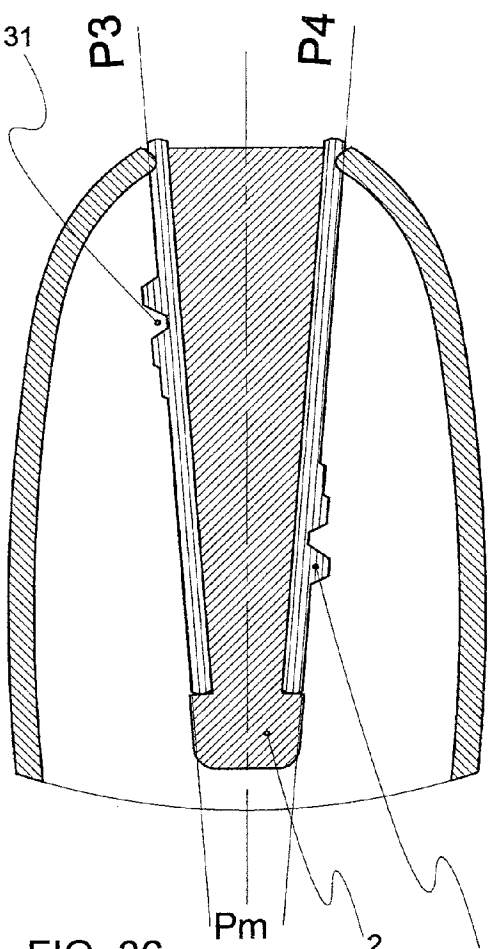
Figure 35:
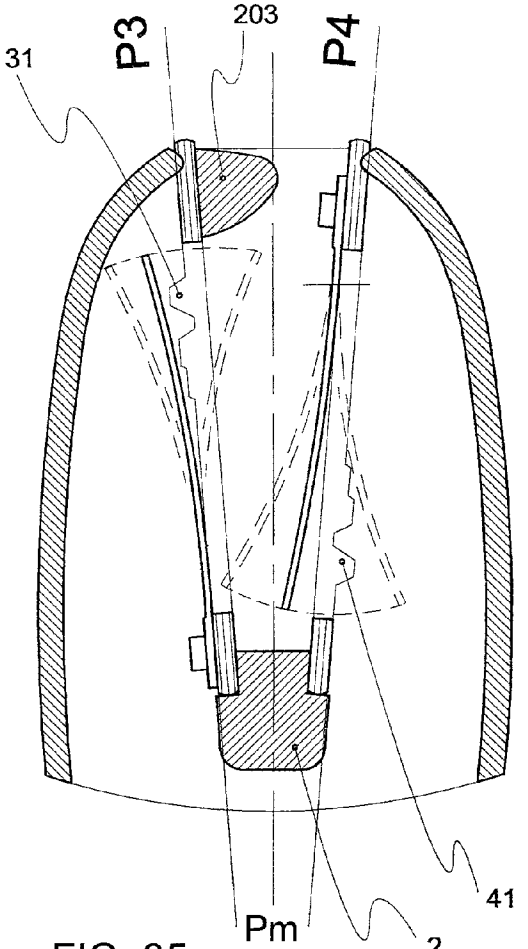
Figure 40:
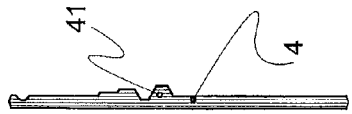
Figure 43:
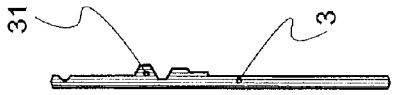
Figure 38:
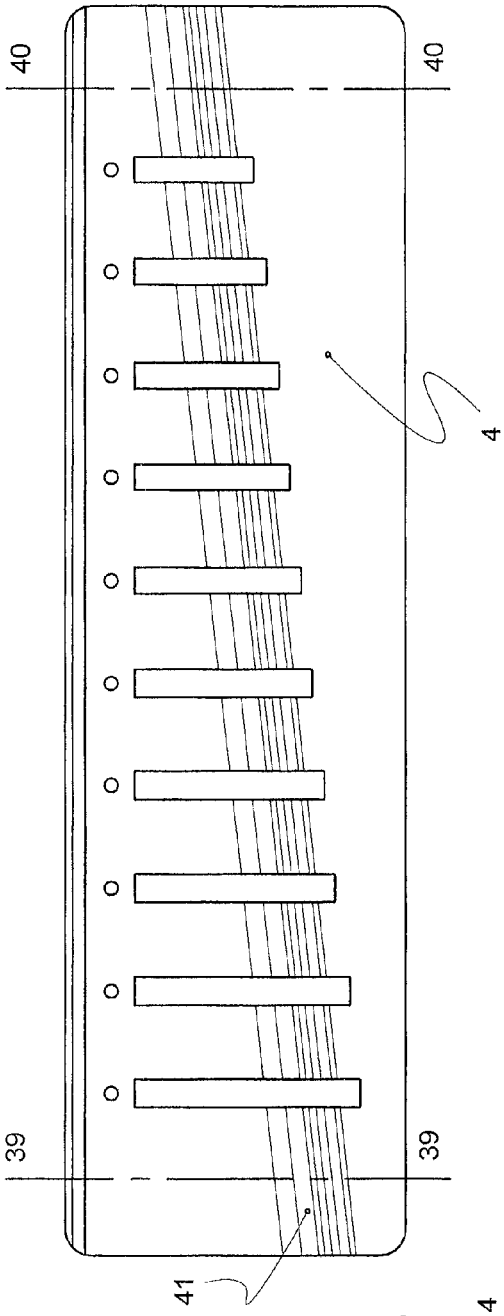
Figure 41:
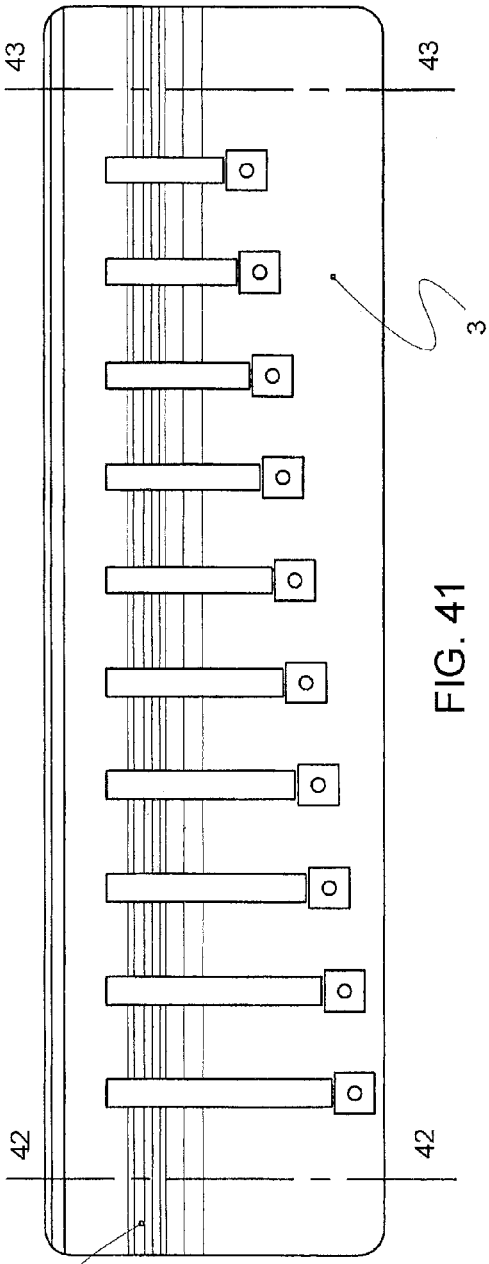
Figure 39:
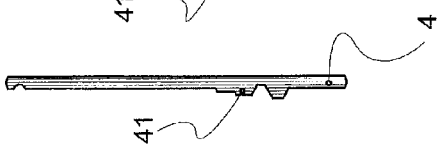
Figure 42:
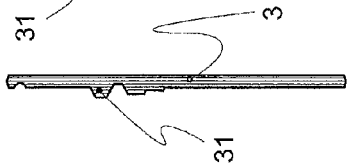

As illustrated in FIGS. 32 and 33, in order that the single reed plate optimally presses against the corresponding face of the comb 2, flexible pressing means are placed at the press-screws 8 and interposed between the internal face of the cover plate and the external of the reed plate. These flexible pressing means are formed by elastically deformable elements such as a compression spring 12 as shown in FIG. 26A or an elastically deformable element which can have in particular the shape of an O-ring 13 as shown in FIG. 27.

As also represented in FIGS. 16, 19 and 20, FIG. 32 shows, in addition, a particular embodiment of the cover plate 5 whose lip 52, on the mouthpiece side of the instrument, presses both against the external face of the reed plate and against the comb by covering the section of the reed plate, which makes it possible to further improve the tightness by a deflecting effect while offering, in addition, an easier and more comfortable slide for the player's lips. Press-screw 8 includes plane Ps.

Figure 34:
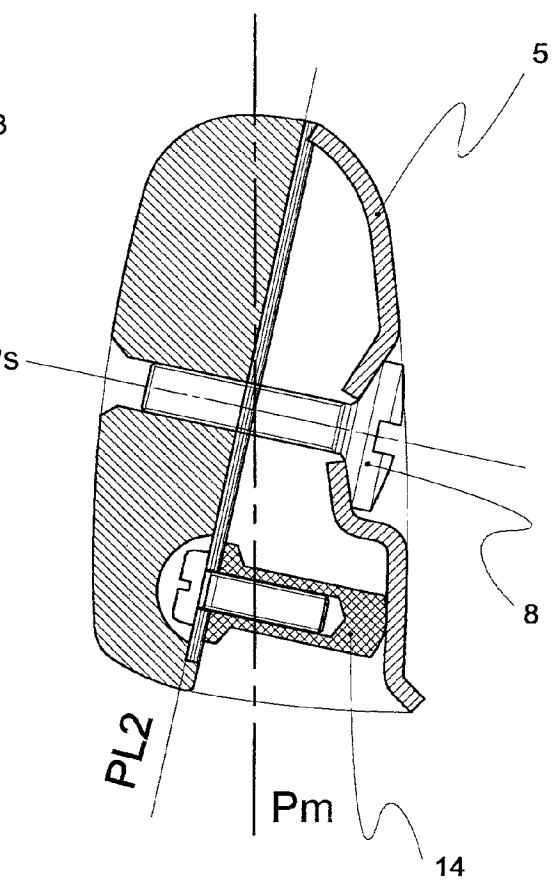

FIG. 34 shows an alternative embodiment in which the cover plate 5 is produced by means of a buckled sheet, said cover plate pressing on the comb via a pressing tab 14 firmly fixed to the reed plate.

FIGS. 35 to 49 represent various alternative embodiments of the reed plates for harmonicas according to the invention for enriching the pitch of the emitted sounds thanks to the contribution of additional harmonics generated by chopping airflows when the sound reeds oscillate through the corresponding windows in said reed plates.

In the embodiment illustrated in FIGS. 35 to 43, the external faces of the reed plates 3 and 4 comprise multiple step-shaped hollows and bumps 31 and 41 obtained by shaping the reed plates so that said hollows and bumps thus form grooves and ridges, respectively, with respect to the general plane passing through the external face of the reed plate concerned, respectively P3 for the reed plate supporting the draw reeds and P4 for the reed plates supporting the blow reeds. The thickness variations of the reed plates are positioned in the zone of the window swept by the free part of the reed when oscillating so that, for the reed plate 3 supporting the draw reeds, the striation forming said hollows and bumps 31 extend, in the longitudinal direction of the reed plate, in a direction substantially parallel to the longitudinal edge of the reed plate on the mouthpiece side of the instrument. On the other hand, for the reed plate 4 supporting the blow reeds, said striation extend, in the longitudinal direction of said reed plate, in an oblique direction, said striation, at the most high-pitched reed of said reed plates being closer to the upper longitudinal edge of the reed plate on the mouthpiece side of the instrument than to the most low-pitched reed of said reed plate.

Figure 46:
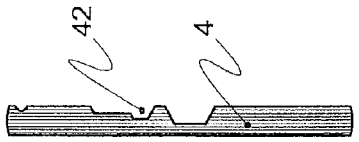
Figure 44:
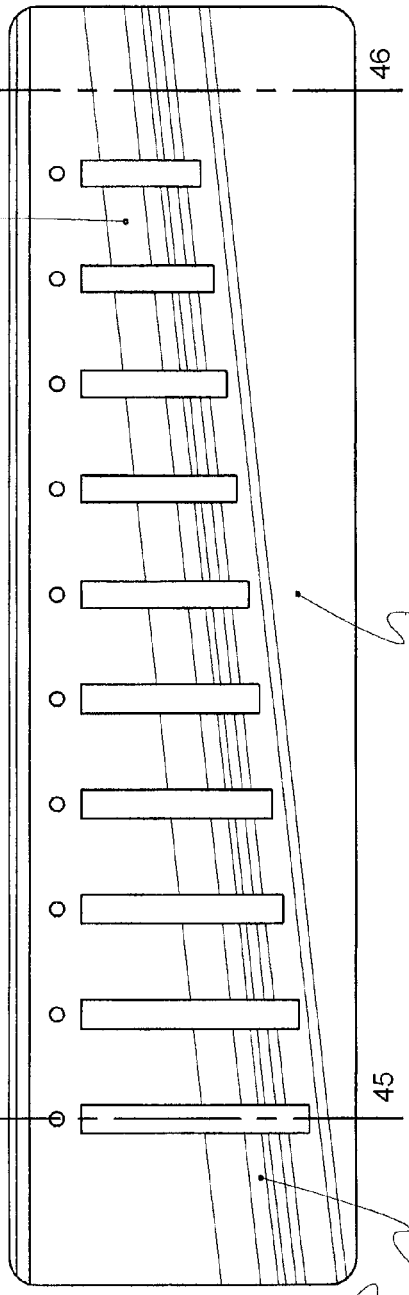
Figure 45:
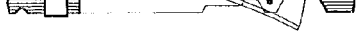
Figure 49:
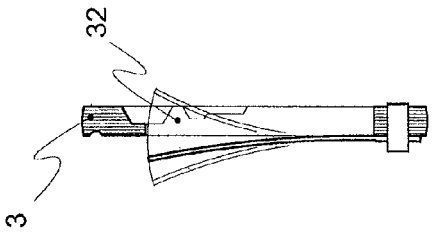
Figure 47:
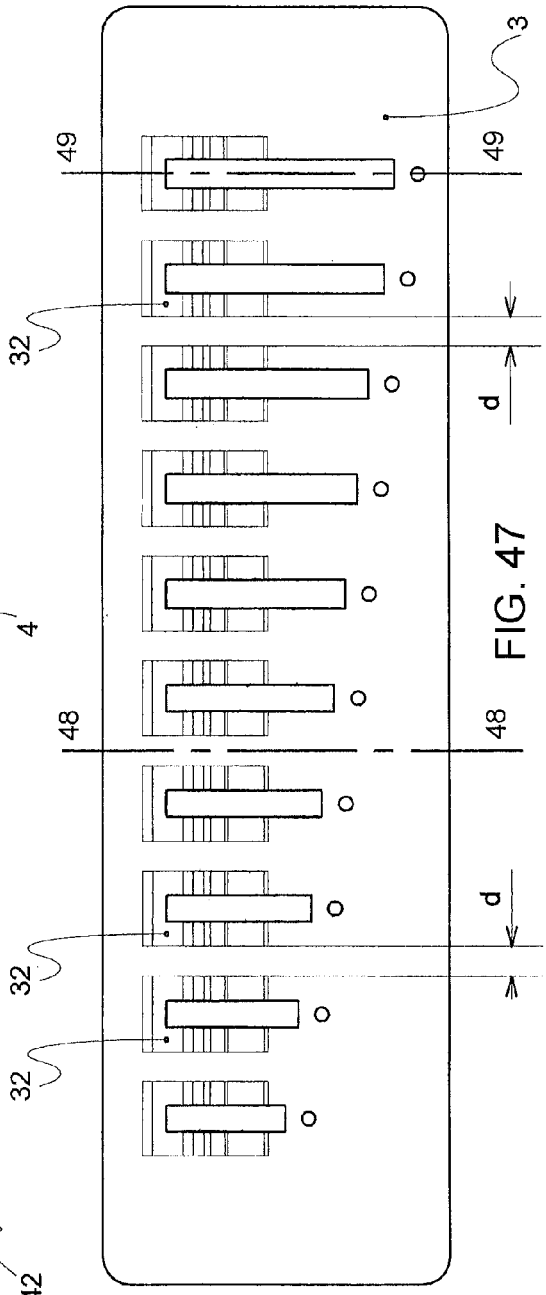
Figure 48:
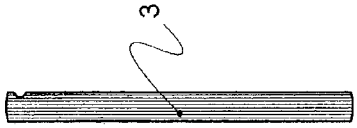

FIGS. 44 to 49 show another embodiment in which the thickness variations of the reed plates on the side of the windows through which the sound reeds oscillate are composed of grooves and ridges 32 and 42 obtained by machining the face of the reed plate through which the air flows out after passing through the window concerned. Said machining is thus performed on the external face of the reed plate 4 supporting the blow reeds whereas it is performed on the internal face, therefore on the face against the comb 2 for the reed plate 3 supporting the draw reeds. The striation can thus extend continuously over the entire length of the reed plate supporting the blow reeds as illustrated in FIGS. 44, 45, 46 whereas, for the reed plates supporting the draw reeds, this machining must be stopped in order to make flat spaces with a sufficient width d for allowing a leak-free tightness on the side of the sections of the walls separating the channels to one another.

Figure 50:
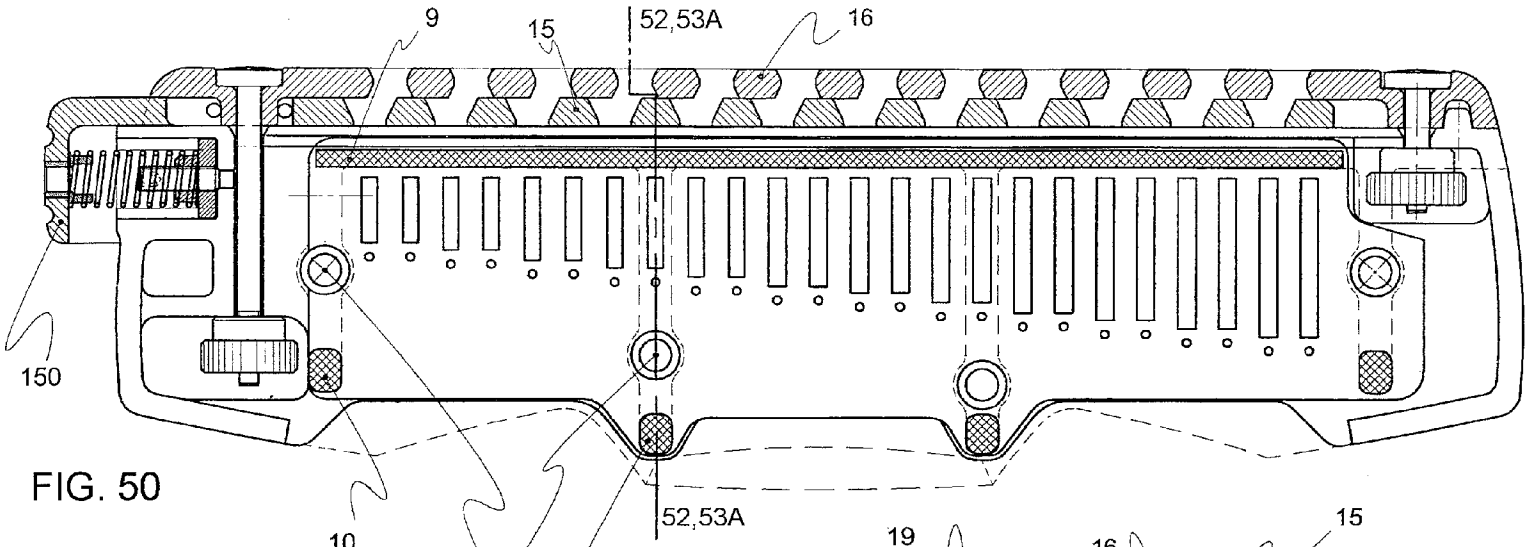
Figure 51:
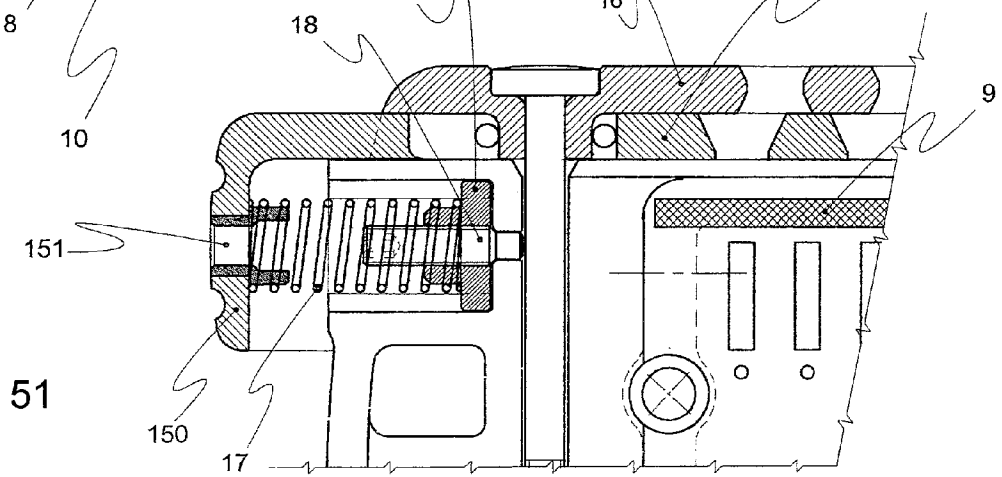

FIGS. 50, 51 and 52 show a chromatic harmonica according to the invention. In this embodiment, each mouthpiece hole in the mouthpiece element 16 supplies two air flow channels, the flows of drawn and blown air being selectively oriented towards either of said channels by means of a sliding air distributor 15. Each of the two channels contains both a draw reed and a blow reed respectively mounted on a reed plate 3 supporting all the draw reeds and on the reed plate 4 supporting all the blow reeds. The reed plate 3 supporting all the draw reeds and the reed plate 4 supporting all the draw reeds are disposed opposite one another, on both sides of the average longitudinal plane Pm of the harmonica and they are positioned obliquely with respect to one another in such a way that the planes passing through their face pressing against the comb 2 form a dihedron open towards the mouthpiece of the instrument.

The operating principle of the pressing cover plate ensuring the positioning and the tightness between the comb, the reed plates and the cover plates, by cantilever effect, is in every respect similar to the operating principle previously described in this document for the diatonic harmonicas without air distributor.

FIG. 51 is a magnification of a detail in FIG. 50 showing in more detail the principle of adjusting the mechanical bias of the spring 17 ensuring the automatic return to a position out of the sliding air distributor 15 when the player does not exert any more pressure on the control unit formed by the button 150. The mechanical bias of said spring 17 can be very easily adjusted from the outside of the instrument, without dismounting it, by simply introducing through the opening 151 in the control button 150 the end of a screwdriver in order to rotate the threaded pin 18 whose rotation cause the translation of the threaded support 19 the spring 17 presses on. As the support 19 is immobilized in rotation but able to slide in translation in the direction of the longitudinal axis of the pin 18, the rotation of said threaded pin 18 makes it possible to adjust the mechanical bias of the spring and thus the return force it generates in order to adapt it exactly to the player's desire.

FIG. 52 shows, for at least some sound reeds of the instrument, an opening 58 in the pressing cover plate covering the reed plate 3 supporting the draw reeds, said opening positioned opposite the free end of the draw reed concerned allowing air flows to reach the reed without following a long, narrow and tortuous way from the bell as it is the case with the prior art harmonicas.

It should be noted that, although all the Figures show a comb whose two planes passing through the pressing faces of the reed plates form a dihedron open towards the mouthpiece, one would not be out of the scope of the invention if the harmonica had the features of this invention by associating them with a comb whose pressing faces of the reed plates would be disposed parallel to one another according to the traditional mode or if said pressing faces were disposed in such a way that the planes containing them formed a dihedron open towards the bell of the instrument.

FIGS. 53A and 53B show that at least some pressing zones, or otherwise all of them, as represented in these two Figures, of the pressing cover plates 5 and 5 against the reed plates 3 and 4 are provided with elastically deformable elements 510 and 511 for compensating for the flatness defects between said zones in contact. The elastic shoe 510 mounted at the end of the pressing tab 51 is configured so as to have a mushroom shape whose stem is placed in a housing of adapted shape in said tab whereas the elastic element 511 on the side of the upper lip of said pressing cover plates is composed of a profile having a T-shaped cross-section whose central wall is placed in a groove extending all along the lip of the cover plate concerned.

The invention is not limited to the embodiments shown or described in this document, but it also includes all the technical equivalents as well as their combinations.

The invention claimed is:

1. Harmonica comprising:

a comb or windchest in the thickness of which are made a plurality of air flow channels, said comb supporting at least one reed plate on which is mounted sound reeds whose oscillations are caused by the flows of air generated by the player through the mouthpiece holes ending in the mouthpiece face of the instrument, a peripheral shell enabling to hold the harmonica, said shell comprising at least one cover plate for amplifying of the sounds and projecting them towards the bell of the instrument, wherein:

each reed plate is sandwiched between the pressing face concerned of the comb and corresponding the cover plate, said cover plate pressing against the external face of the reed plate concerned on the one hand, side mouthpiece of the instrument, via its upper lip pressing all along the upper zone of the reed plate extending in the longitudinal direction of the instrument on the side of the mouthpiece face, and on the other hand on the side of the bell of the instrument via pressing tabs pressing on the external face of the reed plate concerned in zones between the face of the harmonica forming the bell of the instrument and the bottom of the air flow channels supplying the sound reeds, pressing means for pressing the reed plate concerned against the corresponding face of the comb and said cover plate against the external face of the reed plate concerned, said pressing means being composed of at least one screw inserted in the part of the instrument which is delimited, in the longitudinal direction of the harmonica, by the two planes perpendicular to the average longitudinal plane of the instrument, one passing through the longitudinal axis of the air flow channel supplying the most high-pitched reed of the instrument and the other passing through the longitudinal axis of the channel supplying the most low-pitched sound reed of the instrument.

2. Harmonica according to claim 1, wherein:

the longitudinal axis of at least one of the press-screws of the pressing cover plates is positioned at a distance from the mouthpiece face inferior to the distance separating said mouthpiece face of the bottom of the air flow channel supplying the most low-pitched reed of the instrument, under the pressing action of said screw, the cover plate concerned exerts against the reed plate concerned a pressing force in four distinct zones around sad screw: on the one hand, a pressing zone at the mouthpiece face of the instrument and a diametrically opposite pressing zone on the side of the house of the instrument, and on the other hand two pressing zones on both sides of said screw in the longitudinal direction of the instrument.

3. Harmonica according to claim 1, comprising at least one press-screw extending through a lateral separating wall for two adjacent channels and in that the axis of the stem of said screw is positioned at a distance from the mouthpiece face inferior to the distance separating said mouthpiece face from the longest bottom of the two air channels adjoining the separating wall said screw stem extends through.

4. Harmonica according to claim 1, wherein on the side of the mouthpiece of the instrument, the lip of the cover plate presses both against the external face of the reed plates and against the comb while covering the section of the reed plate concerned.

5. Harmonica according to claim 1, comprising immobilizing means for maintaining the reed plates against the face concerned of the comb when the pressing cover plates of the instrument have been removed.

6. Harmonica according to claim 1, wherein the planes passing through the faces of the reed plates pressing against the corresponding faces of the windchest are concurrent and forms a dihedron open towards the mouthpiece of the instrument by forming an angle a.

7. Harmonica according to claim 1, comprising at least one ventilation tunnel allowing air and sound to freely flow directly between the space on the side of the mouthpiece face of the instrument and at least one of the two internal volumes in the harmonica delimited by the internal face of the cover plate concerned and the external face of the corresponding reed plate.

8. Harmonica according to claim 1, comprising:

at least one tunnel serving both internal volumes in the harmonica, one being delimited by the internal face of the cover plate and by the external face of the draw reed plate and the other being delimited by the internal face of the cover plate and the external face of the blow reed plate 4, a flexible tube connected at one of its ends to the input of the tunnel on the side of the mouthpiece face of the instrument while its other end is connected to an earphone-shaped piece inserted into the player's ear in order to better hear the sounds emitted by his/her own instrument when he/she plays in a group of harmonica players or when he/she is accompanied by other instruments.

9. Harmonica according to claim 1, comprising two reed plates for only one type of blow or draw sound reeds and in that, when the instrument is in position to be played and, with respect to the harmonica player, the low-pitched reeds are on his/her left and the high-pitched reeds are on his/her right, the reed plate for the draw sound reeds is disposed against the upper face of the comb while the reed plate for the blow reeds is disposed against the lower face of the comb.

10. Harmonica according to claim 1, wherein all the sound reeds of the instrument are supported by only one reed plate, and in that the two reeds supplied by the same air channel are disposed in line on both sides of the reed plate concerned and their respective longitudinal axes are coplanar with the longitudinal axis of said air channel, while the oscillating free parts of said two sound reeds extend in two diametrically opposite directions relative to one other.

11. Harmonica according to claim 1, comprising:

at least one press-screw positioned in a wall separating, from one another, two adjacent air flow channels whose respective longitudinal axes are divergent when one moves away from the mouthpiece face of the instrument towards the bell the instrument, the longitudinal axis of said press-screw of the pressing cover plates being positioned at a distance from the mouthpiece face of the instrument inferior to the distance of said mouthpiece face where is located the longest bottom of the two air flow channels adjoining the wall in which the above-mentioned press-screw is inserted.

12. Harmonica according to claim 1, wherein for at least some of its draw reeds, an opening is made through the pressing cover plate covering the reed plate supporting the draw reeds and in that said opening is positioned opposite the free end of the draw reed concerned.

13. Harmonica according to claim 1, wherein at least some pressing zones, or otherwise all of them, of the pressing cover plates against the reed plates are provided with elastically deformable elements intended to compensate for the flatness defects between said zones in contact.

14. Harmonica according to claim 1, wherein:

for at least some of its windows, the reed plates, in the part of the window the free part of the sound reed extends through when oscillating, the thickness of the reed plate concerned presents thickness variations having the form of stairs, and/or crenels and/or waves and/or any other forms, these height variations of the side faces of the window can be made in the face of the reed plate on the air input side, therefore in the face of the reed plate against which the sound reed is fixed, as well as in the opposite face on the air exhaust side, These thickness variations can be conformed as hollows as well as bumps with respect to the general plane passing through the face concerned of the reed plate and they can be made locally in an individual way for each window as well as by shaping the reed plates.

15. Harmonica according to claim 1, wherein each mouthpiece hole in the mouthpiece element supplies two air flow channels, each of them supplying at least one draw sound reed and at least one blow sound reed, and in that the flows of drawn and blown air being oriented selectively towards either of said two channels by means of a sliding air distributor.

* * * * *